US010834804B1

(12) United States Patent
McRae

(10) Patent No.: US 10,834,804 B1
(45) Date of Patent: Nov. 10, 2020

(54) LIGHT DISPLAY CONTROL SYSTEM WITH REMOTE CONTROL

(71) Applicant: National Tree Company, Cranford, NJ (US)

(72) Inventor: Michael M. McRae, Ormond Beach, FL (US)

(73) Assignee: National Christmas Products LLC, Cranford, NJ (US)

( * ) Notice: Subject to any disclaimer, the term of this patent is extended or adjusted under 35 U.S.C. 154(b) by 0 days.

(21) Appl. No.: 16/548,494

(22) Filed: Aug. 22, 2019

(51) Int. Cl.

| | |
|---|---|
| ***H05B 47/19*** | (2020.01) |
| ***F21S 4/10*** | (2016.01) |
| ***F21S 10/02*** | (2006.01) |
| ***H05B 47/155*** | (2020.01) |
| ***F21W 121/04*** | (2006.01) |

(52) U.S. Cl.
CPC ..... *H05B 47/19* (2020.01); *F21S 4/10* (2016.01); *F21S 10/02* (2013.01); *H05B 47/155* (2020.01); *F21W 2121/04* (2013.01)

(58) Field of Classification Search
None
See application file for complete search history.

(56) References Cited

U.S. PATENT DOCUMENTS

| | | | | |
|---|---|---|---|---|
| 2002/0047646 | A1* | 4/2002 | Lys | H05B 45/00 315/312 |
| 2015/0359075 | A1* | 12/2015 | Keirstead | H01H 23/145 315/362 |
| 2016/0003447 | A1* | 1/2016 | McRae | A47G 33/06 362/157 |
| 2018/0114434 | A1* | 4/2018 | Newman, Jr. | G08C 17/02 |
| 2018/0184505 | A1* | 6/2018 | Chen | F21V 33/0028 |
| 2019/0141821 | A1* | 5/2019 | Hong | F21V 15/012 |

* cited by examiner

*Primary Examiner* — Crystal L Hammond
(74) *Attorney, Agent, or Firm* — Ellenoff Grossman & Schole LLP; James M. Smedley; Alex Korona

(57) ABSTRACT

Apparatus and associated methods relate to configuring a decorative lighting zone with a zone controller adapted to independently control the lighting in the lighting zone, programming the zone controller to implement a lighting command received from a remote control, and automatically providing a remotely configurable lighting display in the lighting zone based on independently activating the lighting command in the zone controller. In an illustrative example, the lighting command may be a lighting sequence. The lighting zone may be, for example, a multi-color light displaying time-varying artificial tree lighting patterns. In some examples, the zone controller may be a multi-zone controller adapted to permit the remote control to independently program and activate multiple zones. Various examples may advantageously provide a multi-zone, multi-control, multi-color remote control system configured to provide flexible, reconfigurable decorative lighting patterns and sequences coordinated in multiple zones based on a single remote control configuring multiple multi-zone controllers.

22 Claims, 19 Drawing Sheets

LIGHT DISPLAY CONTROL SYSTEM WITH REMOTE CONTROL

TECHNICAL FIELD

Various embodiments relate generally to decorative light control.

BACKGROUND

Decorations are ornamental designs. Decorations include visually perceptible patterns, colors, and shapes. Some decorations may be displayed to call attention to a special occasion. In some scenarios, special decorations may be applied to ornamental objects, to celebrate a season or commemorate an event. In an illustrative example, ornamental objects such as trees and wreaths may be used as decorations to celebrate a holiday season.

Users of decorations include individuals, businesses, and communities. In some scenarios, a user may configure an ornamental object with artificial lights to enhance the visual appearance of the objects when the lights are illuminated. Some artificial lights used with a decoration may be configured for continuous illumination. In some examples, artificial lights may be configured with a decoration to turn on and off in a pattern or sequence of lighting patterns, to enhance a user's enjoyment observing the decoration.

Some decoration displays may be very complex. For example, a holiday display in even a small city's town square may include many illuminated artificial tree, wreath, and candy cane decorations. In an illustrative example, each decoration in an exemplary town square may include separate lights, for each artificial tree, wreath, and candy cane. A user desiring to configure a coordinated decorative holiday light display using multiple illuminated decorations may expend significant effort connecting, configuring, and activating the display.

SUMMARY

Apparatus and associated methods relate to configuring a decorative lighting zone with a zone controller adapted to independently control the lighting in the lighting zone, programming the zone controller to implement a lighting command received from a remote control, and automatically providing a remotely configurable lighting display in the lighting zone based on independently activating the lighting command in the zone controller. In an illustrative example, the lighting command may be a lighting sequence. The lighting zone may be, for example, a multi-color light displaying time-varying artificial tree lighting patterns. In some examples, the zone controller may be a multi-zone controller adapted to permit the remote control to independently program and activate multiple zones. Various examples may advantageously provide a multi-zone, multi-control, multi-color remote control system configured to provide flexible, reconfigurable decorative lighting patterns and sequences coordinated in multiple zones based on a single remote control configuring multiple multi-zone controllers.

Various embodiments may achieve one or more advantages. For example, some embodiments may improve a user's ease configuring decorative lighting displays. This facilitation may be a result of reducing the user's effort adjusting lighting patterns and configuring lighting sequences in the user's illuminated decorations. In some embodiments, lighting patterns or lighting sequences illuminating separate decorations may be automatically coordinated according to the user's preferences programmed in a single remote control. Such automatic coordination, from a single remote control, of lighting patterns or lighting sequences illuminating separate decorations may reduce a user's effort synchronizing lighting patterns in multiple illuminated decorations. Some embodiments may permit a user to easily define and construct multiple independently controlled illuminated zones related to a user's lighted decorative display, with individual zones displaying a lighting sequence or lighting pattern distinct from the lighting sequence or lighting pattern displayed by other zones. Such ease of configuring multiple independently controlled illuminated zones in a user's decorative lighting display may reduce the user's effort preparing a decorative display with multiple lighting patterns or lighting sequences in different areas of each decoration. Such reduced effort preparing a decorative display may be a result of reducing the need to install and connect multiple lights in multiple areas of each decoration in a multiple decoration display. For example, a multi-zone, multi-control, multi-color remote control system configured to provide flexible, reconfigurable decorative lighting patterns and sequences coordinated in multiple zones may permit a user to adjust lighting patterns or lighting sequences illuminating multiple decorations more quickly, reducing the need to install multiple independent decorative lights with only a predetermined illumination pattern or sequence.

In some embodiments, the effort required by a user to select and activate illumination patterns or illumination sequences in multiple zones may be reduced. This facilitation may be a result of a lighting zone receiver/controller configured to receive an illumination pattern or illumination sequence configured by a user in a remote control in communication with the lighting zone receiver/controller. For example, a user who operates many illuminated decorations may change the lighting pattern or lighting sequence in their decorations from the remote control governing one or more lighting zone receiver controller. Some embodiments may improve the user's experience designing an illuminated decorative display. This facilitation may be a result of a remote control user interface adapted to permit the user to remotely configure flexible, reconfigurable decorative lighting patterns and sequences coordinated in multiple zones based on a single remote control configuring multiple multi-zone controllers. For example, a multi-zone, multi-control, multi-color remote control system may indicate lighting receiver/controllers available to be programmed with coordinated illumination patterns or illumination sequences in selected zones, and allow the user to remotely adjust the illuminated decorative display parameters to optimize the user's experience.

The details of various embodiments are set forth in the accompanying drawings and the description below. Other features and advantages will be apparent from the description and drawings, and from the claims.

BRIEF DESCRIPTION OF THE DRAWINGS

Like reference symbols in the various drawings indicate like elements.

DETAILED DESCRIPTION OF ILLUSTRATIVE EMBODIMENTS

To aid understanding, this document is organized as follows. First, exemplary design and usage of an embodiment multi-zone, multi-control, multi-color remote control system configured to provide flexible and reconfigurable decorative lighting patterns and sequences coordinated in multiple zones is briefly introduced with reference to FIG. 1. Second, with reference to FIGS. 2-6, the discussion turns to examples illustrative of various embodiment remote decorative light control systems in exemplary decorative illumination scenarios. Specifically, single and multi-zone control of decorative illumination patterns and sequences in home exterior and Christmas tree embodiments are disclosed. Then, with reference to FIGS. 7-9, exemplary decorative light control network, remote control, and receiver controller embodiment designs are disclosed. Finally, with reference to FIGS. 10-19, the design and use of various decorative light control component embodiment implementations are presented to explain improvements in decorative light control technology.

Figure 1:
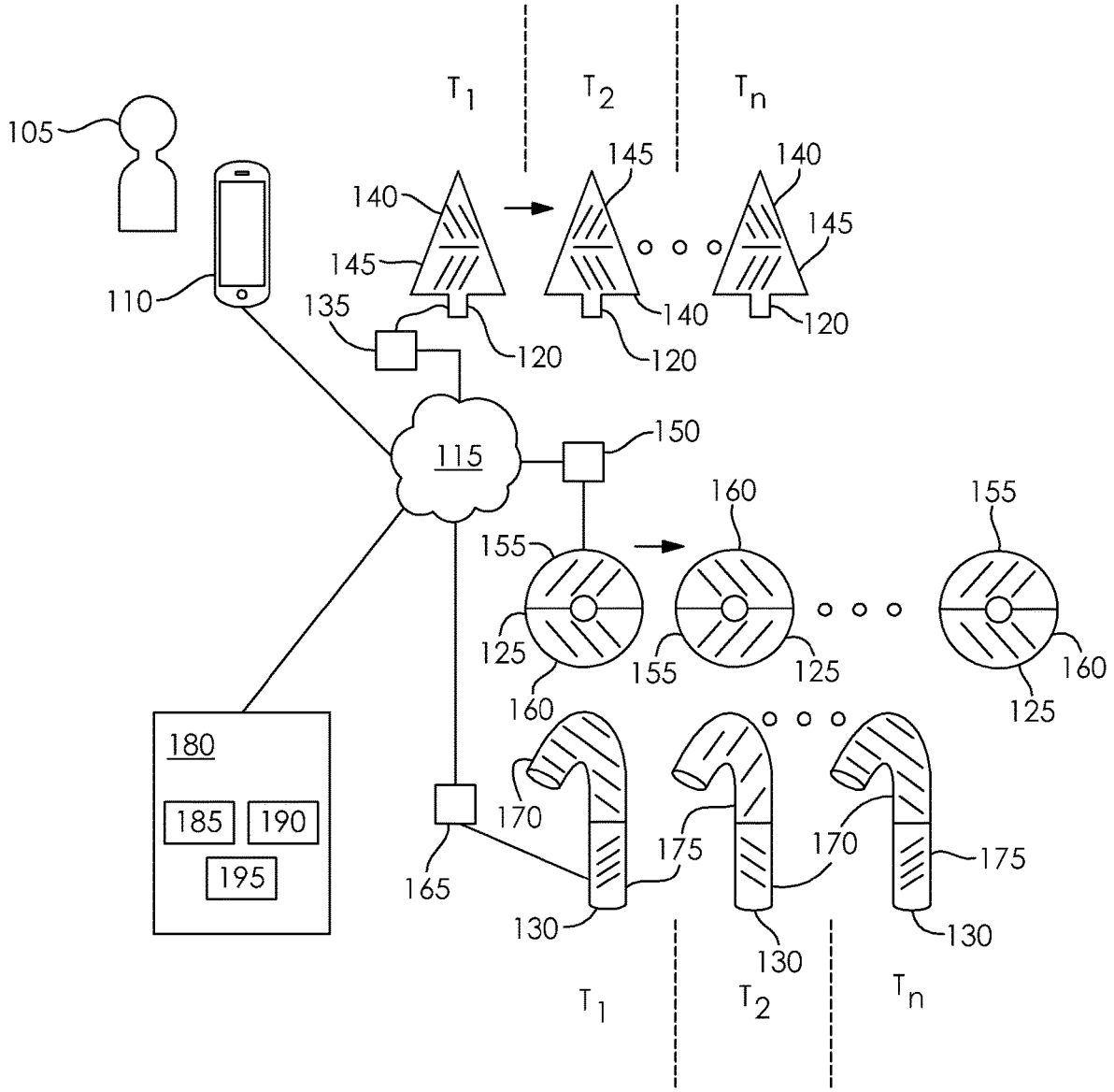
FIG. 1 depicts an illustrative decorative illumination scenario exemplary of a multi-zone, multi-control, multi-color remote control system configured to provide flexible and reconfigurable decorative lighting patterns and sequences coordinated in multiple zones based on configuring a decorative lighting zone with a zone controller adapted to independently control the lighting in the lighting zone, programming the zone controller to implement a lighting command received from a remote control, and automatically providing a remotely configurable lighting display in the lighting zone based on independently activating the lighting command in the zone controller.

FIG. 1 depicts an illustrative decorative illumination scenario exemplary of a multi-zone, multi-control, multi-color remote control system configured to provide flexible and reconfigurable decorative lighting patterns and sequences coordinated in multiple zones based on configuring a decorative lighting zone with a zone controller adapted to independently control the lighting in the lighting zone, programming the zone controller to implement a lighting command received from a remote control, and automatically providing a remotely configurable lighting display in the lighting zone based on independently activating the lighting command in the zone controller. In the example depicted by FIG. 1, the user 105 employs the remote control 110 through the network cloud 115 to create and control a coordinated light display in multiple zones of the illuminated tree 120, the illuminated wreath 125, and the illuminated candy cane 130. In the illustrated example, the receiver controller 135 governs the lighting of the illuminated tree 120 in collaboration with the remote control 110. In the depicted example, the receiver controller 150 governs the lighting of the illuminated wreath 125 in collaboration with the remote control 110. In the illustrated example, the receiver controller 165 governs the lighting of the illuminated candy cane 130 in collaboration with the remote control 110. In some examples, a receiver controller may be referred to as a zone controller. In the depicted example, during the exemplary time period T1, the receiver controller 135 activates the lighting pattern 140 in the upper portion of the illuminated tree 120. In the illustrated example, also during the exemplary time period T1, the receiver controller 135 also activates the lighting pattern 145 in the lower portion of the illuminated tree 120. In various examples, one or more of the lighting pattern 140 or lighting pattern 145 may be activated in the illuminated tree 120 by the receiver controller 135 based on a lighting command sent from the remote control 110 to the receiver controller 135. In the depicted example, the receiver controller 135 is a multi-zone receiver controller. In various examples, the receiver controller 135 may be a single zone receiver controller. In some embodiments, the receiver controller 135 may activate lighting patterns based on a pattern generator internal to the receiver controller 135. In various embodiments, a lighting command sent from the remote control 110 to the receiver controller 135 may indicate a user selected pattern for the individual zone controller output to the selected zone, bypassing the zone controller internal pattern generator. In the depicted example, during the exemplary time period T2, the receiver controller 135 activates the lighting pattern 145 in the upper portion of the illuminated tree 120. In the illustrated example, also during the exemplary time period T2, the receiver controller 135 also activates the lighting pattern 140 in the lower portion of the illuminated tree 120. In subsequent exemplary time periods Tn, the lighting pattern may repeat as depicted. In some examples, the lighting patterns activated by a zone controller may be in any sequence. In the illustrated example, during the exemplary time period T1, the receiver controller 150 activates the lighting pattern 155 in the upper portion of the illuminated wreath 125. In the illustrated example, also during the exemplary time period T1, the receiver controller 150 also activates the lighting pattern 160 in the lower portion of the illuminated wreath 125. In various examples, one or more of the lighting pattern 155 or lighting pattern 160 may be activated in the illuminated wreath 125 by the receiver controller 150 based on a lighting command sent from the remote control 110 to the receiver controller 150. In the depicted example, the receiver controller 150 is a multi-zone receiver controller. In various examples, the receiver controller 150 may be a single zone receiver controller. In some embodiments, the receiver controller 150 may activate lighting patterns based on a pattern generator internal to the receiver controller 150. In various embodiments, a lighting command sent from the remote control 110 to the receiver controller 150 may indicate a user selected pattern for the individual zone controller output to the selected zone, bypassing the zone controller internal pattern generator. In the depicted example, during the exemplary time period T2, the receiver controller 150 activates the lighting pattern 160 in the upper portion of the illuminated wreath 125. In the illustrated example, also during the exemplary time period T2, the receiver controller 150 also activates the lighting pattern 155 in the lower portion of the illuminated wreath 125. In subsequent exemplary time periods Tn, the lighting pattern may repeat as depicted. In some examples, the lighting patterns activated by a zone controller may be in any sequence. In the illustrated example, during the exemplary time period T1, the receiver controller 165 activates the lighting pattern 170 in the upper portion of the illuminated candy cane 130. In the illustrated example, also during the exemplary time period T1, the receiver controller 165 also activates the lighting pattern 175 in the lower portion of the illuminated candy cane 130. In various examples, one or more of the lighting pattern 170 or lighting pattern 175 may be activated in the illuminated candy cane 130 by the receiver controller 165 based on a lighting command sent from the remote control 110 to the receiver controller 165. In the depicted example, the receiver controller 165 is a multi-zone receiver controller. In various examples, the receiver controller 165 may be a single zone receiver controller. In some embodiments, the receiver controller 165 may activate lighting patterns based on a pattern generator internal to the receiver controller 165. In various embodiments, a lighting command sent from the remote control 110 to the receiver controller 165 may indicate a user selected pattern for the individual zone controller output to the selected zone, bypassing the zone controller internal pattern generator. In the depicted example, during the exemplary time period T2, the receiver controller 165 activates the lighting pattern 175 in the upper portion of the illuminated candy cane 130. In the illustrated example, also during the exemplary time period T2, the receiver controller 165 also activates the lighting pattern 170 in the lower portion of the illuminated candy cane 130. In subsequent exemplary time periods Tn, the lighting pattern may repeat as depicted. In some examples, the lighting patterns activated by a zone controller may be in any sequence. In the depicted example, the illumination zone cloud server 180 includes illumination pattern and sequence data 185, user profile data 190, and illumination component capability and usage data 195. In some embodiments, the user 105 may configure and activate lighting patterns stored in the illumination pattern and sequence data 185 in the receiver controller 135, receiver controller 150, or receiver controller 165. In various examples, the user 105 may access an account profile based on the user profile data 190 and configure customized lighting displays chosen from a lighting component inventory characterized by the predetermined illumination component capability and usage data 195 and the user 105 account profile.

Figure 2A:
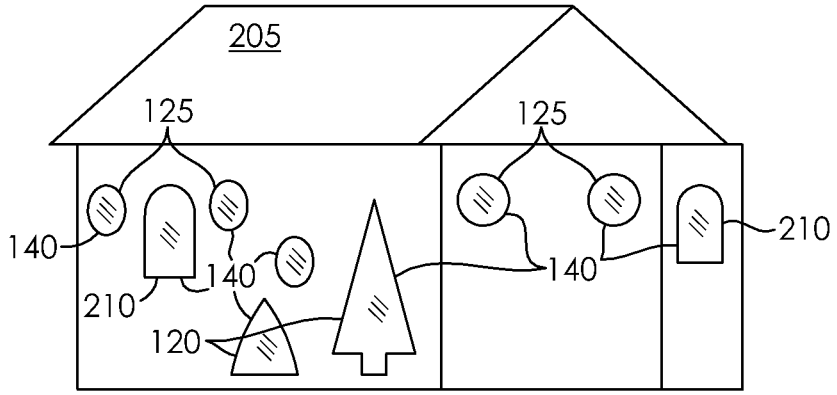
FIGS. 2A-2C together depict an illustrative decorative illumination scenario exemplary of a remote decorative light control system configured to provide flexible and reconfigurable decorative lighting patterns and sequences.
Figure 2B:
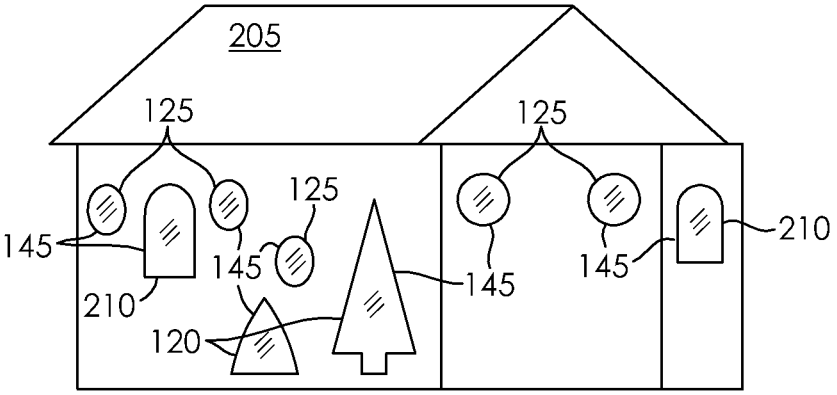
Figure 2C:
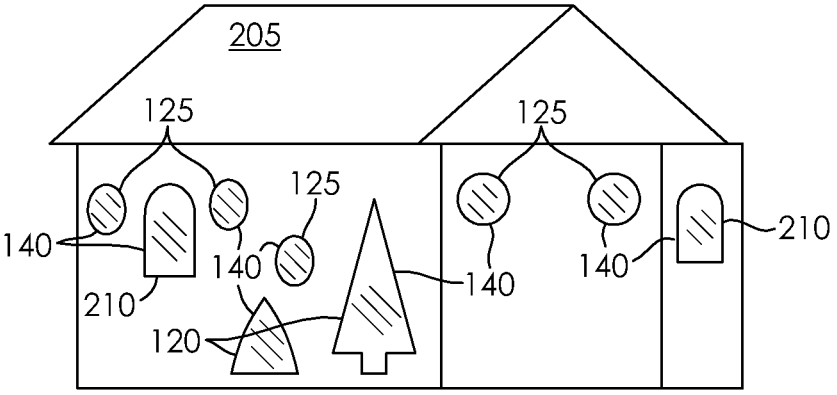

FIGS. 2A-2C together depict an illustrative decorative illumination scenario exemplary of a remote decorative light control system configured to provide flexible and reconfigurable decorative lighting patterns and sequences. In the depicted example, a receiver controller in collaboration with a remote control governs decorative lighting configured in the house 205 windows 210. In the illustrated example, the house 205 is decorated with the illuminated trees 120 and the illuminated wreaths 125. In the depicted example, the house 205 windows 210 are configured with decorative lights also governed by the receiver controller in collaboration with the remote control. In the depicted example, the receiver controller is a single zone receiver controller. In some embodiments, the receiver controller may activate lighting patterns based on a pattern generator internal to the receiver controller. In various embodiments, a lighting command sent from the remote control to the receiver controller may indicate a user selected pattern for the individual zone controller output to the selected zone, bypassing the zone controller internal pattern generator. In an exemplary first time period depicted by FIG. 2A, the receiver controller activates the lighting pattern 140 in the configured illumination zone including the illuminated trees 120, the illuminated wreaths 125, and the windows 210. In an exemplary second time period depicted by FIG. 2B, the receiver controller activates the lighting pattern 145 in the configured illumination zone including the illuminated trees 120, the illuminated wreaths 125, and the windows 210. In an exemplary third time period depicted by FIG. 2C, the receiver controller activates the lighting pattern 140 in the configured illumination zone including the illuminated trees 120, the illuminated wreaths 125, and the windows 210. In various examples, illumination pattern activation in the configured zone by the exemplary receiver controller may repeat, or may proceed in any sequence or pattern configured in the receiver controller by a user of the remote control.

Figure 3A:
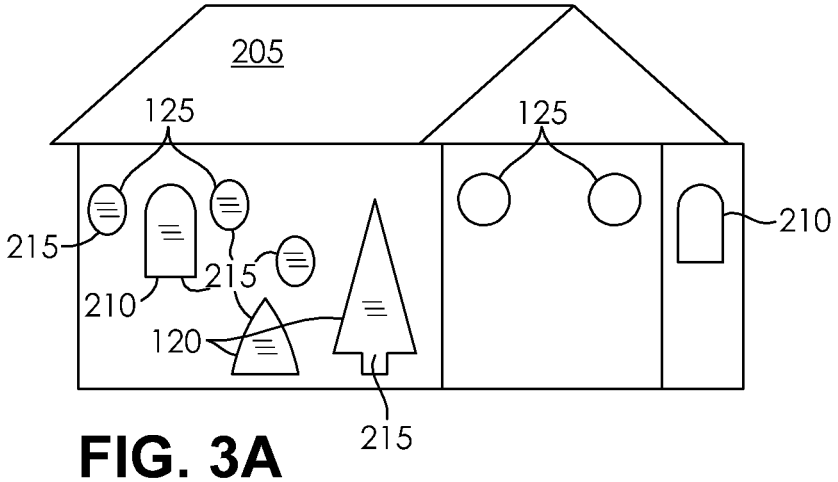
FIGS. 3A-3C together depict an illustrative decorative illumination scenario exemplary of a remote decorative light control system configured to provide flexible and reconfigurable decorative lighting patterns and sequences.
Figure 3B:
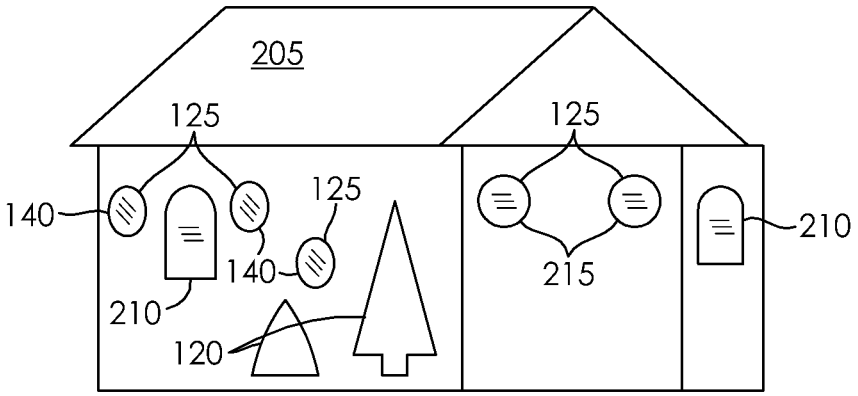
Figure 3C:
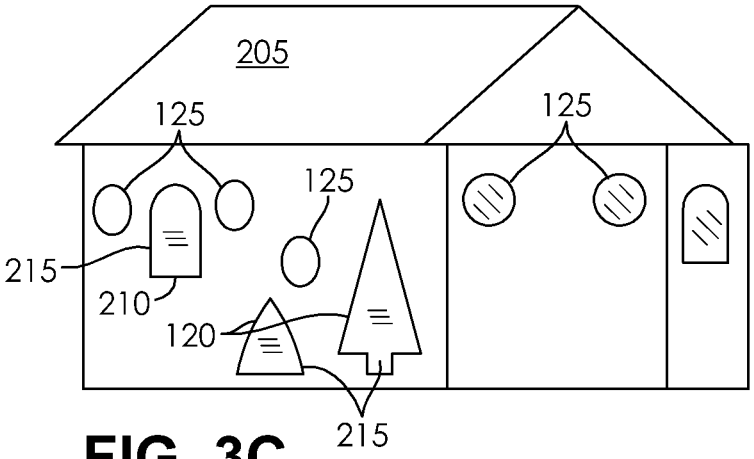

FIGS. 3A-3C together depict an illustrative decorative illumination scenario exemplary of a remote decorative light control system configured to provide flexible and reconfigurable decorative lighting patterns and sequences. In the illustrated example, a receiver controller in collaboration with a remote control governs decorative lighting in two independent illumination control zones configured in the house 205 including the windows 210. In the illustrated example, the house 205 is decorated with the illuminated trees 120 and the illuminated wreaths 125. In the depicted example, the house 205 windows 210 are configured with decorative lights also governed by the receiver controller in collaboration with the remote control. In the depicted example, the receiver controller is a multi-zone receiver controller governing lighting in two independent illumination control zones. In some embodiments, the receiver controller may activate lighting patterns based on a pattern generator internal to the receiver controller. In various embodiments, a lighting command sent from the remote control to the receiver controller may indicate a user selected pattern for the individual zone controller outputs to the selected zones, bypassing the zone controller internal pattern generators. In an exemplary first time period depicted by FIG. 3A, the receiver controller activates the lighting pattern 215 in the configured illumination zone at the left side of the house 205, including the illuminated trees 120, the illuminated wreaths 125, and the window 210. In an exemplary second time period depicted by FIG. 3B, the receiver controller activates the lighting pattern 215 in the configured illumination zone at the right side of the house 205 including the illuminated wreaths 125 and the window 210. In the exemplary time period depicted by FIG. 3B, the receiver controller also activates the lighting pattern 140 in the configured illumination zone at the left side of the house 205 including the illuminated wreaths 125. In the exemplary time period depicted by FIG. 3B, the receiver controller deactivates the lighting pattern 215 in the configured illumination control zone at the left side of the house 205 including the illuminated trees 120. In various examples, the illuminated trees 120 may present continuous white light, remain dark, or display a predetermined lighting pattern, when the lighting pattern 215 is deactivated by the receiver controller. In an exemplary third time period depicted by FIG. 3C, the receiver controller activates the lighting pattern 140 in the configured illumination zone at the right side of the house 205 including the illuminated wreaths 125 and the window 210. In the exemplary time period depicted by FIG. 3C, the receiver controller also activates the lighting pattern 215 in the illumination control zone at the left side of the house 205 including the window 210 and the illuminated trees 120. In the exemplary time period depicted by FIG. 3C, the receiver controller deactivates the lighting pattern 140 in the configured illumination control zone at the left side of the house 205 including the illuminated wreaths 125. In various examples, the illuminated wreaths 125 may present continuous white light, remain dark, or display a predetermined lighting pattern, when the lighting pattern 140 is deactivated by the receiver controller. In various examples, illumination pattern activation in the configured zone by the exemplary receiver controller may repeat, or may proceed in any sequence or pattern configured in the receiver controller by a user of the remote control.

Figure 4A:
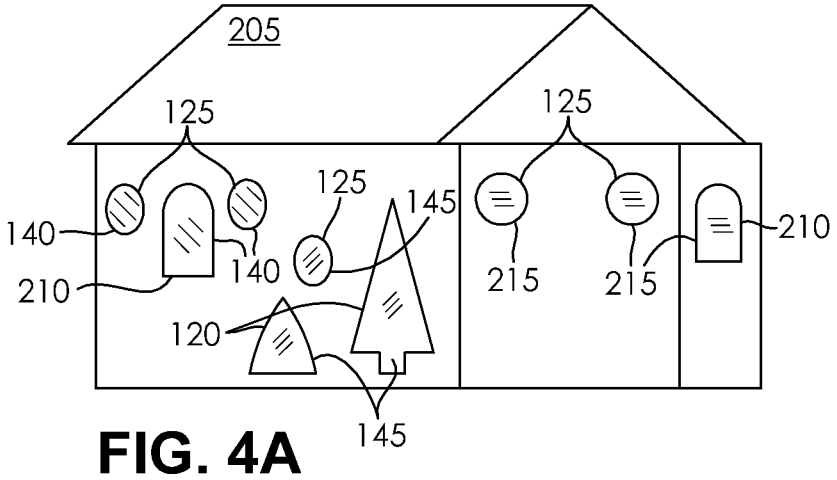
FIGS. 4A-4C together depict an illustrative decorative illumination scenario exemplary of a remote decorative light control system configured to provide flexible and reconfigurable decorative lighting patterns and sequences.
Figure 4B:
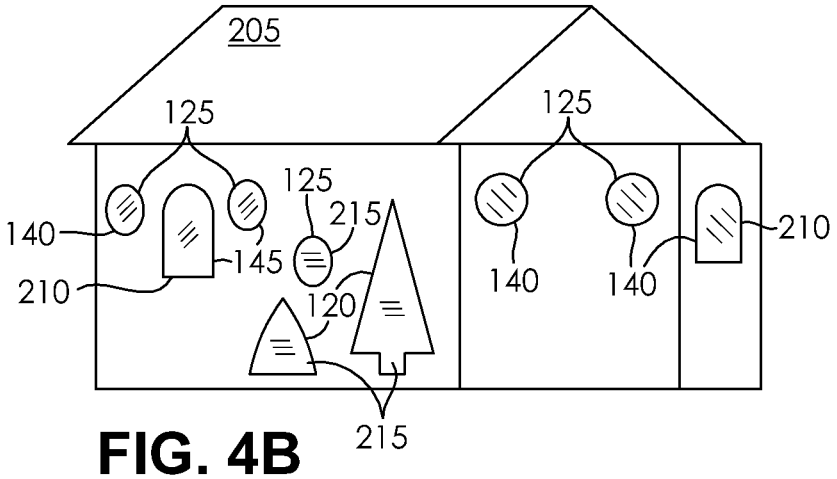
Figure 4C:
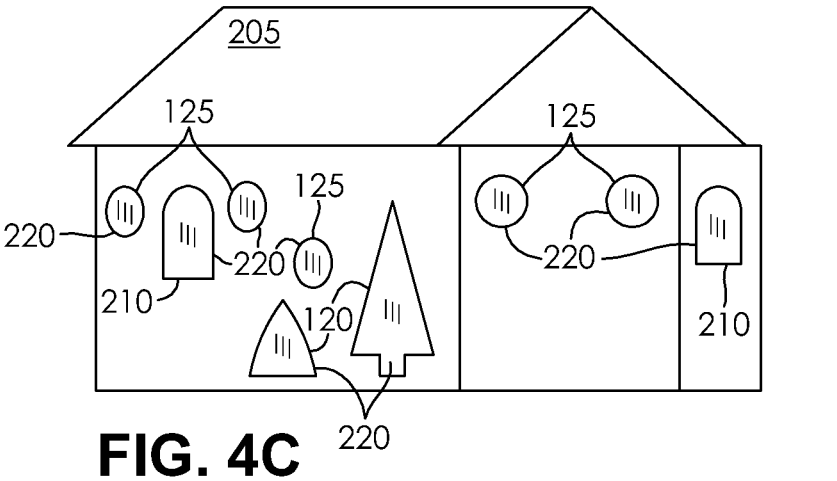

FIGS. 4A-4C together depict an illustrative decorative illumination scenario exemplary of a remote decorative light control system configured to provide flexible and reconfigurable decorative lighting patterns and sequences. In the illustrated example, a receiver controller in collaboration with a remote control governs decorative lighting in three independent illumination control zones configured in the house 205 including the windows 210. In the illustrated example, the house 205 is decorated with the illuminated trees 120 and the illuminated wreaths 125. In the depicted example, the house 205 windows 210 are configured with decorative lights also governed by the receiver controller in collaboration with the remote control. In the depicted example, the receiver controller is a multi-zone receiver controller governing lighting in three independent illumination control zones. In some embodiments, the receiver controller may activate lighting patterns based on a pattern generator internal to the receiver controller. In various embodiments, a lighting command sent from the remote control to the receiver controller may indicate a user selected pattern for the individual zone controller outputs to the selected zones, bypassing the zone controller internal pattern generators. In an exemplary first time period depicted by FIG. 4A, the receiver controller activates the lighting pattern 145 in the configured illumination zone at the left side of the house 205, including the illuminated trees 120, and one of the illuminated wreaths 125. In the exemplary first time period illustrated by FIG. 4A, the receiver controller also activates the lighting pattern 140 in the configured illumination control zone at the left side of the house 205 including the window 210 between the illuminated wreaths 125. In the exemplary first time period depicted by FIG. 4A, the receiver controller also activates the lighting pattern 215 in the configured illumination control zone at the right side of the house 205 including the window 210 and the illuminated wreaths 125. In an exemplary second time period depicted by FIG. 4B, the receiver controller activates the lighting pattern 215 in the configured illumination zone at the left side of the house 205, including the illuminated trees 120, and one of the illuminated wreaths 125. In the exemplary second time period illustrated by FIG. 4B, the receiver controller also activates the lighting pattern 145 in the configured illumination control zone at the left side of the house 205 including the window 210 between the illuminated wreaths 125. In the exemplary second time period depicted by FIG. 4B, the receiver controller also activates the lighting pattern 140 in the configured illumination control zone at the right side of the house 205 including the window 210 and the illuminated wreaths 125. In an exemplary third time period depicted by FIG. 4C, the receiver controller activates the lighting pattern 220 in the two configured illumination control zones at the left side of the house 205, including the illuminated trees 120, the illuminated wreaths 125, and the window 210. In the exemplary third time period illustrated by FIG. 4C, the receiver controller also activates the lighting pattern 220 in the configured illumination control zone at the left side of the house 205 including the window 210 between the illuminated wreaths 125. In various examples, the illuminated trees 120, illuminated wreaths 125, or window 210 may present continuous white light, remain dark, or display a predetermined lighting pattern, when one or more lighting pattern is deactivated by the receiver controller. In various examples, illumination pattern activation in a configured zone by the exemplary receiver controller may repeat, or may proceed in any sequence or pattern configured in the receiver controller by a user of the remote control.

Figure 5A:
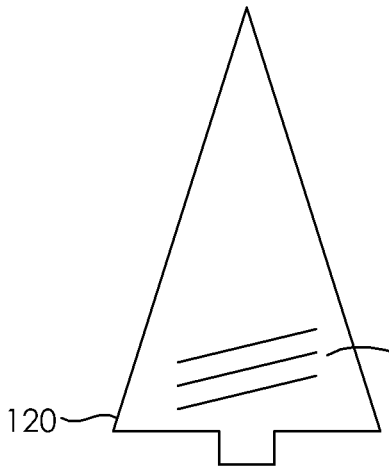
FIGS. 5A-5D together depict an illustrative decorative illumination scenario exemplary of a remote decorative light control system configured to provide flexible and reconfigurable decorative lighting patterns and sequences.
Figure 5B:
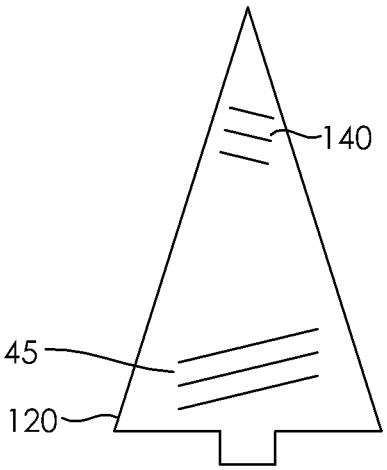
Figure 5C:
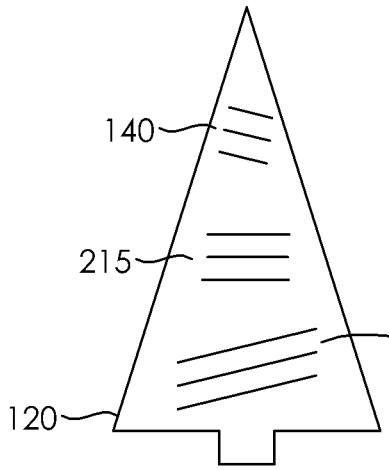
Figure 5D:
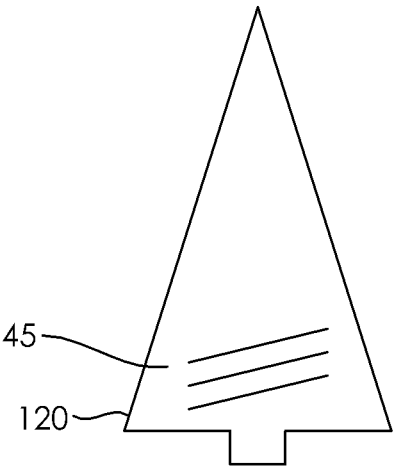

FIGS. 5A-5D together depict an illustrative decorative illumination scenario exemplary of a remote decorative light control system configured to provide flexible and reconfigurable decorative lighting patterns and sequences. In the depicted example, the exemplary illuminated tree 120 is configured with three separate displays in three independent illumination control zones. In the illustrated embodiment, the lighting displayed by the three independent illumination control zones configured in the illuminated tree 120 is governed by an embodiment multi-zone receiver controller in collaboration with an embodiment remote control. In the depicted example, each of the three illumination control zones are configured in a section of the illuminated tree 120. In the illustrated example, the multi-zone receiver controller is configured to independently govern lighting in an illumination control zone defined in each of the top, middle, and bottom sections of the illuminated tree 120. In the illustrated example, each exemplary illumination control zone configured in the illuminated tree 120 fades clear to multicolor and back, with each section operating at its own speed. In an illustrative example, the fading, sequencing, and speed may be changed from the remote control, so that the illumination control zones may fade in sequence; for example, first, then top, then the middle, then the bottom, or, or in the reverse order. In FIG. 5A, in an illustrative first time period, the exemplary multi-zone receiver controller activates the light pattern 145 in the bottom section of the illuminated tree 120. In FIG. 5B, in an illustrative second time period, the exemplary multi-zone receiver controller activates the light pattern 140 in the top of the illuminated tree 120. In an illustrative example, during the exemplary second time period, the light pattern 145 in the bottom of the illuminated tree 120 remains activated by the multi-zone receiver controller. In FIG. 5C, in an exemplary third time period, the exemplary multi-zone receiver controller activates the light pattern 215 in the middle of the illuminated tree 120. In an illustrative example, during the exemplary third time period, the light pattern 145 in the bottom of the illuminated tree 120 and the light pattern 140 in the top of the illuminated tree 120 remain activated by the multi-zone receiver controller. In FIG. 5D, in an exemplary fourth time period, the exemplary multi-zone receiver controller deactivates the lighting pattern 140 in the top of the illuminated tree 120 and the lighting pattern 215 in the middle of the illuminated tree 120. In various examples, the illuminated tree 120 may present continuous white light, remain dark, or display a predetermined lighting pattern, when a lighting pattern is deactivated by the multi-zone receiver controller. In various examples, illumination pattern activation in a configured zone by the exemplary multi-zone receiver controller may repeat, or may proceed in any sequence or pattern configured in the multi-zone receiver controller by a user of the remote control.

Figure 6A:
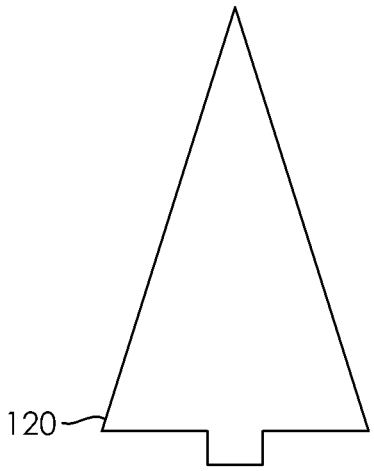
FIGS. 6A-6D together depict an illustrative decorative illumination scenario exemplary of a remote decorative light control system configured to provide flexible and reconfigurable decorative lighting patterns and sequences.
Figure 6B:
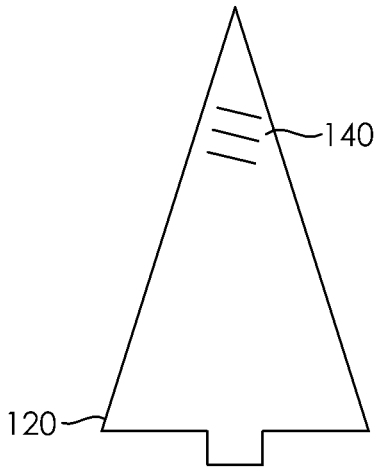
Figure 6C:
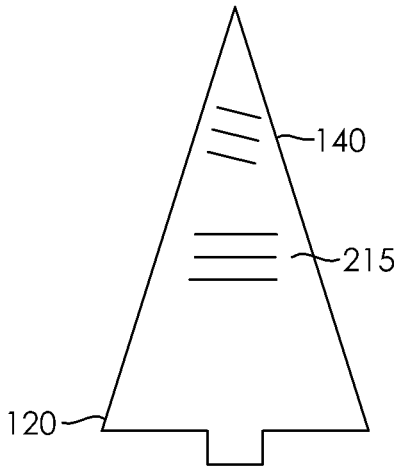
Figure 6D:
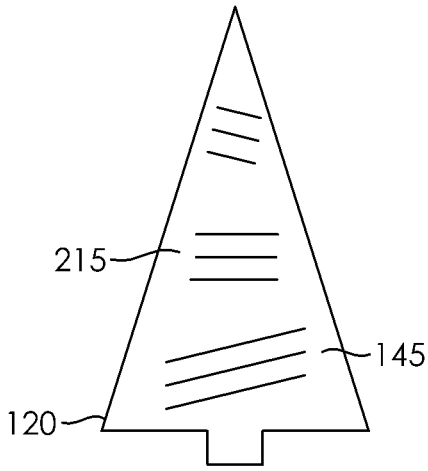

FIGS. 6A-6D together depict an illustrative decorative illumination scenario exemplary of a remote decorative light control system configured to provide flexible and reconfigurable decorative lighting patterns and sequences. In the depicted example, the exemplary illuminated tree 120 is configured with three separate displays in three independent illumination control zones. In the illustrated embodiment, the lighting displayed by the three independent illumination control zones configured in the illuminated tree 120 is governed by an embodiment multi-zone receiver controller in collaboration with an embodiment remote control. In the depicted example, each of the three illumination control zones are configured in a section of the illuminated tree 120. In the illustrated example, the multi-zone receiver controller is configured to independently govern lighting in an illumination control zone defined in each of the top, middle, and bottom sections of the illuminated tree 120. In the illustrated example, each exemplary illumination control zone configured in the illuminated tree 120 fades clear to multicolor and back, with each section operating at its own speed. In an illustrative example, the fading, sequencing, and speed may be changed from the remote control, so that the illumination control zones may fade in sequence; for example, first, then top, then the middle, then the bottom, or, or in the reverse order. In some embodiments, the lighting patterns displayed by the depicted three sections each operating independently may be configured, for example, to change top to bottom in a waterfall-like pattern. In various designs, the depicted lighting patterns displayed in the exemplary sections may be configured to change clear to multicolor, flashing, first top to middle, then bottom, and holding each pattern for a time period configured by the user, or predetermined based on profile data. In some implementations, the depicted lighting patterns displayed in the exemplary sections may be configured to change top to bottom, flashing at a configurable rate. In an illustrative example, the embodiment multi-zone receiver controller may operate a multi-display tree, or multiple displays in separate areas. In FIG. 6A, in an illustrative first time period, the exemplary multi-zone receiver controller has not yet activated any light pattern in the illuminated tree 120. In FIG. 6B, in an illustrative second time period, the exemplary multi-zone receiver controller activates the light pattern 140 in the top of the illuminated tree 120. In FIG. 6C, in an exemplary third time period, the exemplary multi-zone receiver controller activates the light pattern 215 in the middle of the illuminated tree 120. In an illustrative example, during the exemplary third time period, the light pattern 140 in the top of the illuminated tree 120 remains activated by the multi-zone receiver controller. In FIG. 6D, in an exemplary fourth time period, the exemplary multi-zone receiver controller activates the lighting pattern 145 in the bottom of the illuminated tree 120. In the exemplary fourth time period depicted by FIG. 6D, the light pattern 215 in the middle of the illuminated tree 120 and the light pattern 140 in the top of the illuminated tree 120 remain activated by the exemplary multi-zone receiver controller. In some examples, one or more light pattern in the illuminated tree 120 may be deactivated by the exemplary multi-zone receiver controller. In various examples, the illuminated tree 120 may present continuous white light, remain dark, or display a predetermined lighting pattern, when a lighting pattern is deactivated by the multi-zone receiver controller. In various examples, illumination pattern activation in a configured zone by the exemplary multi-zone receiver controller may repeat, or may proceed in any sequence or pattern configured in the multi-zone receiver controller by a user of the remote control.

Figure 7:
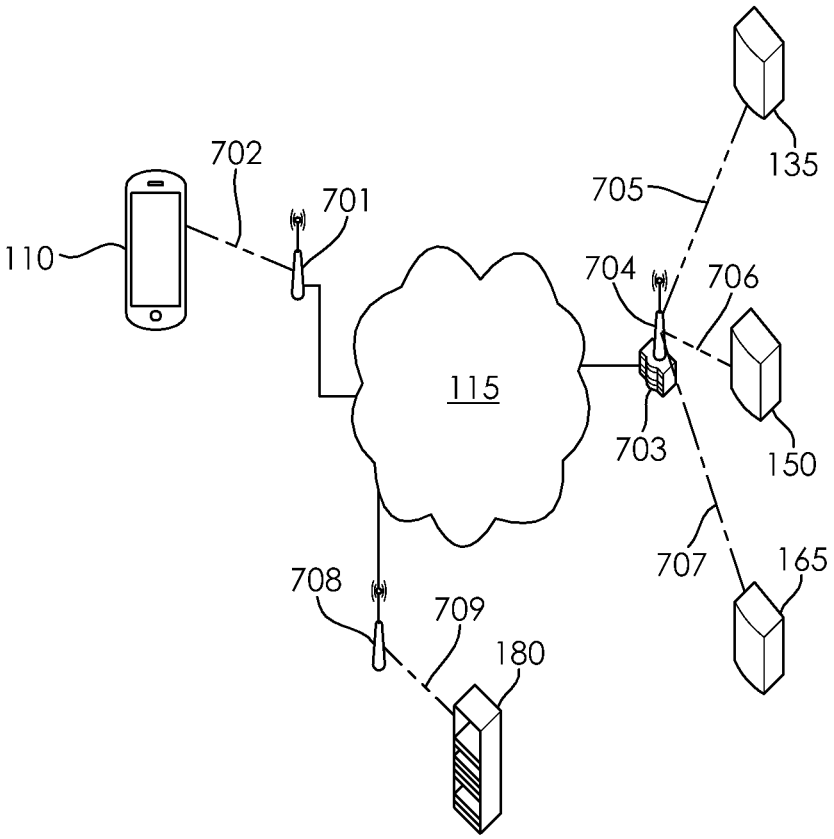
FIG. 7 depicts a schematic view of an exemplary remote decorative light control network configured to provide flexible and reconfigurable decorative lighting patterns and sequences.

FIG. 7 depicts a schematic view of an exemplary remote decorative light control network configured to provide flexible and reconfigurable decorative lighting patterns and sequences. In FIG. 7, according to an exemplary embodiment of the present disclosure, data may be transferred to the system, stored by the system and/or transferred by the system to users of the system across local area networks (LANs) or wide area networks (WANs). In accordance with various embodiments, the system may include numerous servers, data mining hardware, computing devices, or any combination thereof, communicatively connected across one or more LANs and/or WANs. One of ordinary skill in the art would appreciate that there are numerous manners in which the system could be configured, and embodiments of the present disclosure are contemplated for use with any configuration. Referring to FIG. 7, a schematic overview of a system in accordance with an embodiment of the present disclosure is shown. In the depicted embodiment, an exemplary system includes the exemplary remote control 110 configured to permit a user to remotely coordinate and control reconfigurable decorative lighting patterns and sequences. In the illustrated embodiment, the receiver/controller 135 is an electronic device adapted communicate with the remote control 110 to selectively and independently power and control a plurality of lighting elements operably coupled with the receiver controller 135. In the depicted embodiment, the receiver/controller 150 is an electronic device adapted communicate with the remote control 110 to selectively and independently power and control a plurality of lighting elements operably coupled with the receiver controller 150. In the illustrated embodiment, the receiver/controller 165 is an electronic device adapted communicate with the remote control 110 to selectively and independently power and control a plurality of lighting elements operably coupled with the receiver controller 165. In the depicted example, the illumination zone cloud server 180 is a computing device configured to provide storage and retrieval access to illumination pattern and sequence data, user profile data, and illumination component capability and usage data. In the illustrated embodiment, the remote control 110 is communicatively and operably coupled by the wireless access point 701 and the wireless link 702 with the network cloud 115 (e.g., the Internet) to send, retrieve, or manipulate information in storage devices, servers, and network components, and exchange information with various other systems and devices via the network cloud 115. In the depicted example, the illustrative system includes the router 703 configured to communicatively and operably couple the receiver controller 135 to the network cloud 115 via the wireless access point 704 and the wireless communication link 705. In the illustrated example, the router 703 communicatively and operably couples the receiver controller 150 to the network cloud 115 via the wireless access point 704 and the wireless communication link 706. In the depicted example, the router 703 communicatively and operably couples the receiver controller 165 to the network cloud 115 via the wireless access point 704 and the communication link 707. In the depicted embodiment, the illumination zone cloud server 180 is communicatively and operably coupled with the network cloud 115 by the wireless access point 708 and the wireless communication link 709. In various examples, one or more of: the remote control 110, the receiver controller 135, the receiver controller 150, the receiver controller 165, or the illumination zone cloud server 180 may include an application server configured to store or provide access to information used by the system. In various embodiments, one or more application server may retrieve or manipulate information in storage devices and exchange information through the network cloud 115. In some examples, one or more of: the remote control 110, the receiver controller 135, the receiver controller 150, the receiver controller 165, or the illumination zone cloud server 180 may include various applications implemented as processor-executable program instructions. In some embodiments, various processor-executable program instruction applications may also be used to manipulate information stored remotely and process and analyze data stored remotely across the network cloud 115 (e.g., the Internet). According to an exemplary embodiment, as shown in FIG. 7, exchange of information through the network cloud 115 or other network may occur through one or more high speed connections. In some cases, high speed connections may be over-the-air (OTA), passed through networked systems, directly connected to one or more network cloud 115 or directed through one or more router. In various implementations, one or more router may be optional, and other embodiments in accordance with the present disclosure may or may not utilize one or more router. One of ordinary skill in the art would appreciate that there are numerous ways any or all of the depicted devices may connect with the network cloud 115 for the exchange of information, and embodiments of the present disclosure are contemplated for use with any method for connecting to networks for the purpose of exchanging information. Further, while this application may refer to high speed connections, embodiments of the present disclosure may be utilized with connections of any useful speed. In an illustrative example, components or modules of the system may connect to one or more of: the remote control 110, the receiver controller 135, the receiver controller 150, the receiver controller 165, or the illumination zone cloud server 180 via the network cloud 115 or other network in numerous ways. For instance, a component or module may connect to the system i) through a computing device directly connected to the network cloud 115, ii) through a computing device connected to the network cloud 115 through a routing device, or iii) through a computing device connected to a wireless access point. One of ordinary skill in the art will appreciate that there are numerous ways that a component or module may connect to a device via network cloud 115 or other network, and embodiments of the present disclosure are contemplated for use with any network connection method. In various examples, one or more of: the remote control 110, the receiver controller 135, the receiver controller 150, the receiver controller 165, or the illumination zone cloud server 180 could include a personal computing device, such as a smartphone, tablet computer, wearable computing device, cloud-based computing device, virtual computing device, or desktop computing device, configured to operate as a host for other computing devices to connect to. In some examples, one or more communications means of the system may be any circuitry or other means for communicating data over one or more networks or to one or more peripheral devices attached to the system, or to a system module or component. Appropriate communications means may include, but are not limited to, wireless connections, wired connections, cellular connections, data port connections, Bluetooth® connections, near field communications (NFC) connections, or any combination thereof. One of ordinary skill in the art will appreciate that there are numerous communications means that may be utilized with embodiments of the present disclosure, and embodiments of the present disclosure are contemplated for use with any communications means.

Figure 8:
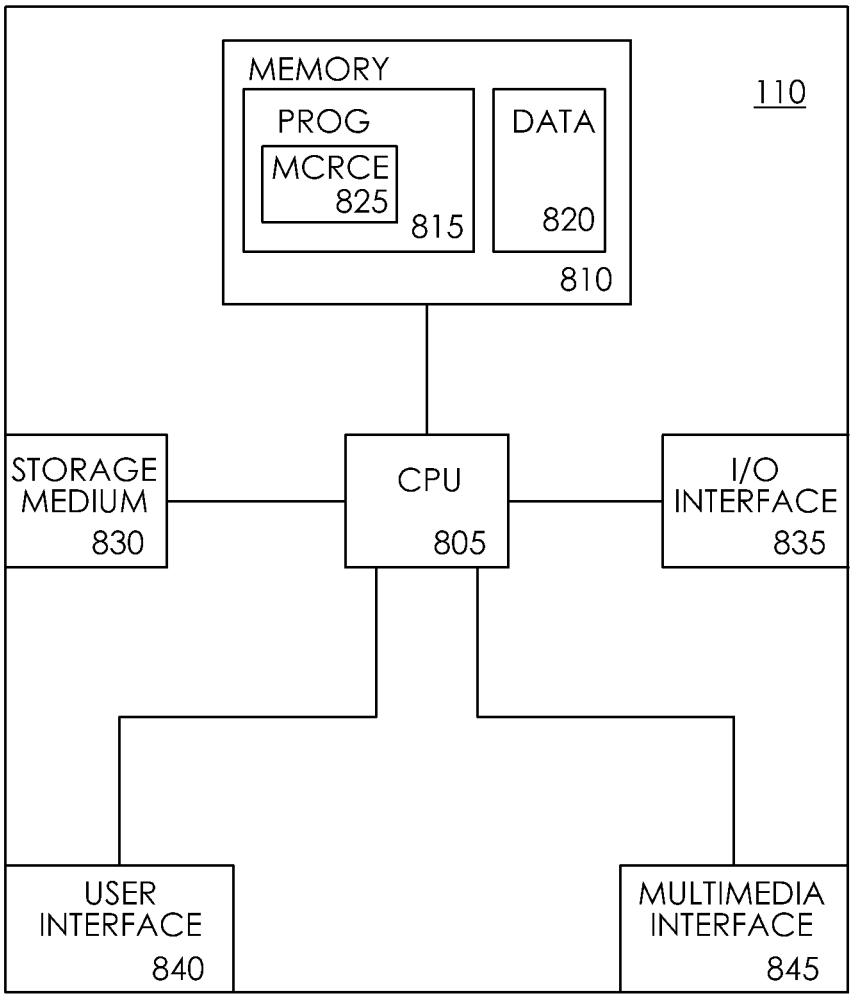
FIG. 8 depicts a structural view of an exemplary remote decorative light control remote control configured with an embodiment Multi-Control Remote Coordination Engine (MCRCE) adapted to provide flexible and reconfigurable decorative lighting patterns and sequences.

FIG. 8 depicts a structural view of an exemplary remote decorative light control remote control configured with an embodiment Multi-Control Remote Coordination Engine (MCRCE) adapted to provide flexible and reconfigurable decorative lighting patterns and sequences. In FIG. 8, the block diagram of the exemplary remote control 110, also depicted at least in FIG. 1 and FIG. 7, includes processor 805 and memory 810. The processor 805 is in electrical communication with the memory 810. The depicted memory 810 includes program memory 815 and data memory 820. The depicted program memory 815 includes processor-executable program instructions implementing the MCRCE (Multi-Control Remote Coordination Engine) 825. In some embodiments, the illustrated program memory 815 may include processor-executable program instructions configured to implement an OS (Operating System). In various embodiments, the OS may include processor executable program instructions configured to implement various operations when executed by the processor 805. In some embodiments, the OS may be omitted. In some embodiments, the illustrated program memory 815 may include processor-executable program instructions configured to implement various Application Software. In various embodiments, the Application Software may include processor executable program instructions configured to implement various operations when executed by the processor 805. In some embodiments, the Application Software may be omitted. In the depicted embodiment, the processor 805 is communicatively and operably coupled with the storage medium 830. In the depicted embodiment, the processor 805 is communicatively and operably coupled with the I/O (Input/Output) interface 835. In the depicted embodiment, the I/O interface 835 includes a network interface. In various implementations, the network interface may be a wireless network interface. In some designs, the network interface may be a Wi-Fi interface. In some embodiments, the network interface may be a Bluetooth interface. In an illustrative example, the remote control 110 may include more than one network interface. In some designs, the network interface may be a wireline interface. In some designs, the network interface may be omitted. In the depicted embodiment, the processor 805 is communicatively and operably coupled with the user interface 840. In various implementations, the user interface 840 may be adapted to receive input from a user or send output to a user. In some embodiments, the user interface 840 may be adapted to an input-only or output-only user interface mode. In various implementations, the user interface 840 may include an imaging display. In some embodiments, the user interface 840 may include an audio interface. In some designs, the audio interface may include an audio input. In various designs, the audio interface may include an audio output. In some implementations, the user interface 840 may be touch-sensitive. In some designs, the remote control 110 may include an accelerometer operably coupled with the processor 805. In various embodiments, the remote control 110 may include a GPS module operably coupled with the processor 805. In an illustrative example, the remote control 110 may include a magnetometer operably coupled with the processor 805. In some embodiments, the user interface 840 may include an input sensor array. In various implementations, the input sensor array may include one or more imaging sensor. In various designs, the input sensor array may include one or more audio transducer. In some implementations, the input sensor array may include a radio-frequency detector. In an illustrative example, the input sensor array may include an ultrasonic audio transducer. In some embodiments, the input sensor array may include image sensing subsystems or modules configurable by the processor 805 to be adapted to provide image input capability, image output capability, image sampling, spectral image analysis, correlation, autocorrelation, Fourier transforms, image buffering, image filtering operations including adjusting frequency response and attenuation characteristics of spatial domain and frequency domain filters, image recognition, pattern recognition, or anomaly detection. In various implementations, the depicted memory 810 may contain processor executable program instruction modules configurable by the processor 805 to be adapted to provide image input capability, image output capability, image sampling, spectral image analysis, correlation, autocorrelation, Fourier transforms, image buffering, image filtering operations including adjusting frequency response and attenuation characteristics of spatial domain and frequency domain filters, image recognition, pattern recognition, or anomaly detection. In some embodiments, the input sensor array may include audio sensing subsystems or modules configurable by the processor 805 to be adapted to provide audio input capability, audio output capability, audio sampling, spectral audio analysis, correlation, autocorrelation, Fourier transforms, audio buffering, audio filtering operations including adjusting frequency response and attenuation characteristics of temporal domain and frequency domain filters, audio pattern recognition, or anomaly detection. In various implementations, the depicted memory 810 may contain processor executable program instruction modules configurable by the processor 805 to be adapted to provide audio input capability, audio output capability, audio sampling, spectral audio analysis, correlation, autocorrelation, Fourier transforms, audio buffering, audio filtering operations including adjusting frequency response and attenuation characteristics of temporal domain and frequency domain filters, audio pattern recognition, or anomaly detection. In some embodiments, the user interface 840 may include part or all of a remote control interface as described with reference to FIG. 16. In various embodiments, the user interface 840 may include part or all of a remote control interface as described with reference to FIG. 17. In the depicted embodiment, the processor 805 is communicatively and operably coupled with the multimedia interface 845. In the illustrated embodiment, the multimedia interface 845 includes interfaces adapted to input and output of audio, video, and image data. In some embodiments, the multimedia interface 845 may include one or more still image camera or video camera. In various designs, the multimedia interface 845 may include one or more microphone. In some implementations, the multimedia interface 845 may include a wireless communication means configured to operably and communicatively couple the multimedia interface 845 with a multimedia data source or sink external to the remote control 110. In various designs, the multimedia interface 845 may include interfaces adapted to send, receive, or process encoded audio or video. In various embodiments, the multimedia interface 845 may include one or more video, image, or audio encoder. In various designs, the multimedia interface 845 may include one or more video, image, or audio decoder. In various implementations, the multimedia interface 845 may include interfaces adapted to send, receive, or process one or more multimedia stream. In various implementations, the multimedia interface 845 may include a GPU. In some embodiments, the multimedia interface 845 may be omitted. Useful examples of the illustrated remote control 110 include, but are not limited to, personal computers, servers, tablet PCs, smartphones, or other computing devices. In some embodiments, multiple remote control 110 devices may be operably linked to form a computer network in a manner as to distribute and share one or more resources, such as clustered computing devices and server banks/farms. Various examples of such general-purpose multi-unit computer networks suitable for embodiments of the disclosure, their typical configuration and many standardized communication links are well known to one skilled in the art, as explained in more detail in the foregoing FIG. 7 description. In some embodiments, an exemplary remote control 110 design may be realized in a distributed implementation. In an illustrative example, some remote control 110 designs may be partitioned between a client device, such as, for example, a phone, and, a more powerful server system, as depicted, for example, in FIG. 7. In various designs, a remote control 110 partition hosted on a PC or mobile device may choose to delegate some parts of computation, such as, for example, machine learning or deep learning, to a host server. In some embodiments, a client device partition may delegate computation-intensive tasks to a host server to take advantage of a more powerful processor, or to offload excess work. In an illustrative example, some devices may be configured with a mobile chip including an engine adapted to implement specialized processing, such as, for example, neural networks, machine learning, artificial intelligence, image recognition, audio processing, or digital signal processing. In some embodiments, such an engine adapted to specialized processing may have sufficient processing power to implement some features. However, in some embodiments, an exemplary remote control 110 may be configured to operate on a device with less processing power, such as, for example, various gaming consoles, which may not have sufficient processor power, or a suitable CPU architecture, to adequately support remote control 110. Various embodiment designs configured to operate on a such a device with reduced processor power may work in conjunction with a more powerful server system.

Figure 9:
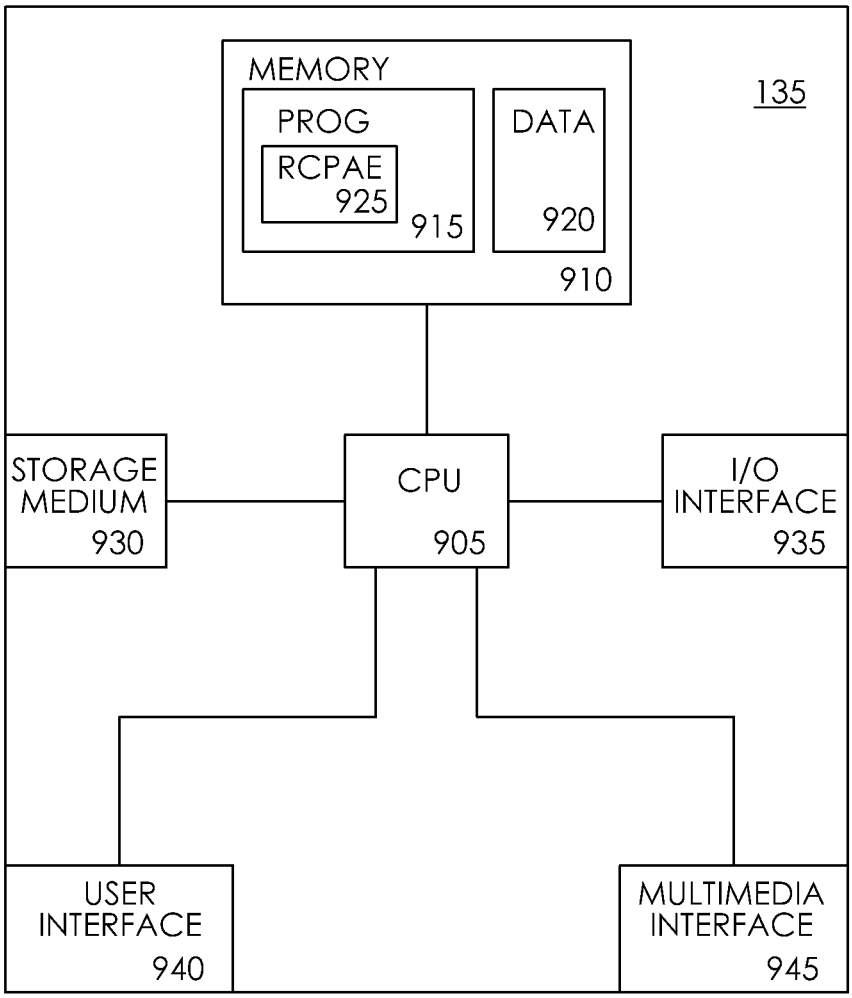
FIG. 9 depicts a structural view of an exemplary remote decorative light control receiver/controller configured with an embodiment Receiver Controller Pattern Activation Engine (RCPAE) adapted to provide flexible and reconfigurable decorative lighting patterns and sequences.

FIG. 9 depicts a structural view of an exemplary remote decorative light control receiver/controller configured with an embodiment Receiver Controller Pattern Activation Engine (RCPAE) adapted to provide flexible and reconfigurable decorative lighting patterns and sequences. In FIG. 9, the block diagram of the exemplary receiver controller 135 is also illustrative of receiver controller 150 and receiver controller 165, which are also depicted in at least FIG. 1 and FIG. 7. In various examples, an embodiment receiver controller may be referred to as a zone controller, or an illumination zone controller. In an illustrative example, an embodiment receiver controller, zone controller, or illumination zone controller is an illumination control device configured to govern illumination in one or more illumination control zone. In the embodiment depicted by FIG. 9, the block diagram of the exemplary receiver controller 135 includes processor 905 and memory 910. The processor 905 is in electrical communication with the memory 910. The depicted memory 910 includes program memory 915 and data memory 920. The depicted program memory 915 includes processor-executable program instructions implementing the RCPAE (Receiver Controller Pattern Activation Engine) 925. In some embodiments, the illustrated program memory 915 may include processor-executable program instructions configured to implement an OS (Operating System). In various embodiments, the OS may include processor executable program instructions configured to implement various operations when executed by the processor 905. In some embodiments, the OS may be omitted. In some embodiments, the illustrated program memory 915 may include processor-executable program instructions configured to implement various Application Software. In various embodiments, the Application Software may include processor executable program instructions configured to implement various operations when executed by the processor 905. In some embodiments, the Application Software may be omitted. In the depicted embodiment, the processor 905 is communicatively and operably coupled with the storage medium 930. In the depicted embodiment, the processor 905 is communicatively and operably coupled with the I/O (Input/Output) interface 935. In the depicted embodiment, the I/O interface 935 includes a network interface. In various implementations, the network interface may be a wireless network interface. In some designs, the network interface may be a Wi-Fi interface. In some embodiments, the network interface may be a Bluetooth interface. In an illustrative example, the receiver controller 135, the receiver controller 150, and the receiver controller 165 may include more than one network interface. In some designs, the network interface may be a wireline interface. In some designs, the network interface may be omitted. In some embodiments, the I/O interface 935 may include part or all of a single output zone Receiver/Controller implementation, as described with reference to FIG. 11. In various designs, the I/O interface 935 may include part or all of a single output zone Receiver/Controller implementation, as described with reference to FIG. 12. In some implementations, the I/O interface 935 may include part or all of a Multi-Zone Output Receiver/Controller implementation, as described with reference to FIG. 14. In some embodiments, the I/O interface 935 may include part or all of a Multi-Zone Output Receiver/Controller implementation, as described with reference to FIG. 15. In the depicted embodiment, the processor 905 is communicatively and operably coupled with the user interface 940. In various implementations, the user interface 940 may be adapted to receive input from a user or send output to a user. In some embodiments, the user interface 940 may be adapted to an input-only or output-only user interface mode. In various implementations, the user interface 940 may include an imaging display. In some embodiments, the user interface 940 may include an audio interface. In some designs, the audio interface may include an audio input. In various designs, the audio interface may include an audio output. In some implementations, the user interface 940 may be touch-sensitive. In some designs, the receiver controller 135, the receiver controller 150, or the receiver controller 165 may include an accelerometer operably coupled with the processor 905. In various embodiments, the receiver controller 135, the receiver controller 150, or the receiver controller 165 may include a GPS module operably coupled with the processor 905. In an illustrative example, the receiver controller 135, the receiver controller 150, or the receiver controller 165 may include a magnetometer operably coupled with the processor 905. In some embodiments, the user interface 940 may include an input sensor array. In various implementations, the input sensor array may include one or more imaging sensor. In various designs, the input sensor array may include one or more audio transducer. In some implementations, the input sensor array may include a radio-frequency detector. In an illustrative example, the input sensor array may include an ultrasonic audio transducer. In some embodiments, the input sensor array may include image sensing subsystems or modules configurable by the processor 905 to be adapted to provide image input capability, image output capability, image sampling, spectral image analysis, correlation, autocorrelation, Fourier transforms, image buffering, image filtering operations including adjusting frequency response and attenuation characteristics of spatial domain and frequency domain filters, image recognition, pattern recognition, or anomaly detection. In various implementations, the depicted memory 910 may contain processor executable program instruction modules configurable by the processor 905 to be adapted to provide image input capability, image output capability, image sampling, spectral image analysis, correlation, autocorrelation, Fourier transforms, image buffering, image filtering operations including adjusting frequency response and attenuation characteristics of spatial domain and frequency domain filters, image recognition, pattern recognition, or anomaly detection. In some embodiments, the input sensor array may include audio sensing subsystems or modules configurable by the processor 905 to be adapted to provide audio input capability, audio output capability, audio sampling, spectral audio analysis, correlation, autocorrelation, Fourier transforms, audio buffering, audio filtering operations including adjusting frequency response and attenuation characteristics of temporal domain and frequency domain filters, audio pattern recognition, or anomaly detection. In various implementations, the depicted memory 910 may contain processor executable program instruction modules configurable by the processor 905 to be adapted to provide audio input capability, audio output capability, audio sampling, spectral audio analysis, correlation, autocorrelation, Fourier transforms, audio buffering, audio filtering operations including adjusting frequency response and attenuation characteristics of temporal domain and frequency domain filters, audio pattern recognition, or anomaly detection. In the depicted embodiment, the processor 905 is communicatively and operably coupled with the multimedia interface 945. In the illustrated embodiment, the multimedia interface 945 includes interfaces adapted to input and output of audio, video, and image data. In some embodiments, the multimedia interface 945 may include one or more still image camera or video camera. In various designs, the multimedia interface 945 may include one or more microphone. In some implementations, the multimedia interface 945 may include a wireless communication means configured to operably and communicatively couple the multimedia interface 945 with a multimedia data source or sink external to the receiver controller 135, the receiver controller 150, or the receiver controller 165. In various designs, the multimedia interface 945 may include interfaces adapted to send, receive, or process encoded audio or video. In various embodiments, the multimedia interface 945 may include one or more video, image, or audio encoder. In various designs, the multimedia interface 945 may include one or more video, image, or audio decoder. In various implementations, the multimedia interface 945 may include interfaces adapted to send, receive, or process one or more multimedia stream. In various implementations, the multimedia interface 945 may include a GPU. In some embodiments, the multimedia interface 945 may be omitted. Useful examples of the exemplary illustrated receiver controller 135, receiver controller 150, and receiver controller 165 designs include, but are not limited to, personal computers, servers, tablet PCs, smartphones, or other computing devices. In some embodiments, multiple receiver controller 135, receiver controller 150, or receiver controller 165 devices may be operably linked to form a computer network in a manner as to distribute and share one or more resources, such as clustered computing devices and server banks/farms. Various examples of such general-purpose multi-unit computer networks suitable for embodiments of the disclosure, their typical configuration and many standardized communication links are well known to one skilled in the art, as explained in more detail in the foregoing FIG. 7 description. In some embodiments, an exemplary receiver controller 135, receiver controller 150, or receiver controller 165 design may be realized in a distributed implementation. In an illustrative example, some receiver controller 135, receiver controller 150, and receiver controller 165 designs may be partitioned between a client device, such as, for example, a phone, and, a more powerful server system, as depicted, for example, in FIG. 7. In various designs, a receiver controller 135, receiver controller 150, or receiver controller 165 partition hosted on a PC or mobile device may choose to delegate some parts of computation, such as, for example, machine learning or deep learning, to a host server. In some embodiments, a client device partition may delegate computation-intensive tasks to a host server to take advantage of a more powerful processor, or to offload excess work. In an illustrative example, some devices may be configured with a mobile chip including an engine adapted to implement specialized processing, such as, for example, neural networks, machine learning, artificial intelligence, image recognition, audio processing, or digital signal processing. In some embodiments, such an engine adapted to specialized processing may have sufficient processing power to implement some features. However, in some embodiments, an exemplary receiver controller 135, receiver controller 150, or receiver controller 165 may be configured to operate on a device with less processing power, such as, for example, various gaming consoles, which may not have sufficient processor power, or a suitable CPU architecture, to adequately support receiver controller 135, receiver controller 150, or receiver controller 165. Various embodiment designs configured to operate on a such a device with reduced processor power may work in conjunction with a more powerful server system.

Figure 10:
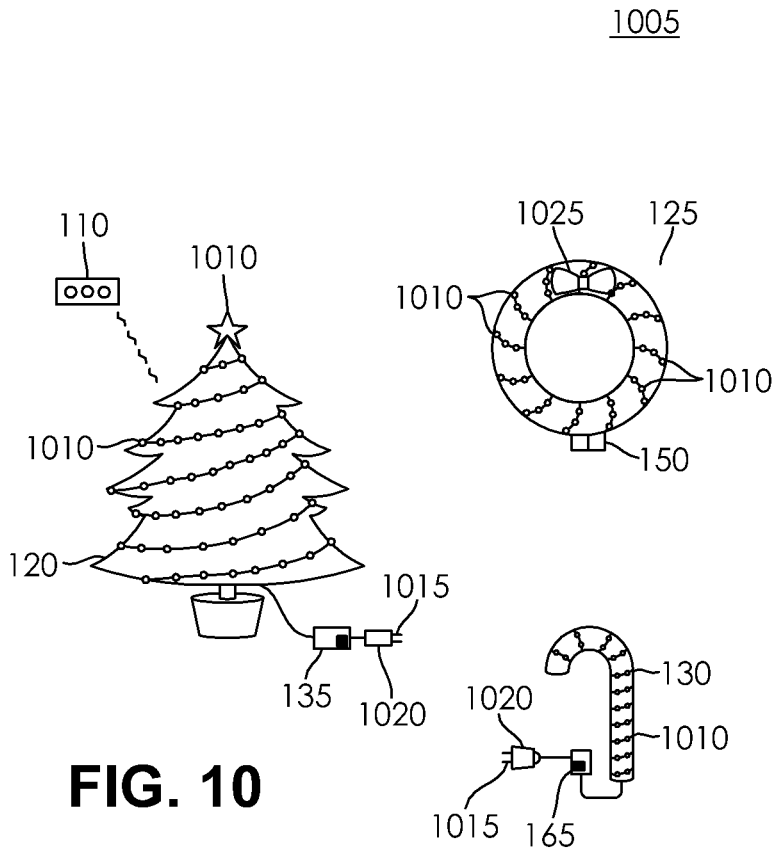
FIG. 10 depicts an exemplary embodiment group of Christmas display items, each configured with a single output zone Receiver/Controller.

FIG. 10 depicts an exemplary embodiment group of Christmas display items, each configured with a single output zone Receiver/Controller. In FIG. 10, the depicted embodiment Group of Christmas display items 1005 include the illuminated tree 120, the illuminated wreath 125, and the illuminated candy cane 130. In the illustrated example, each of the illuminated tree 120, the illuminated wreath 125, and the illuminated candy cane 130 are configured with a single output zone Receiver/Controller to govern each display item's illumination. In an illustrative example, the depicted display items may be AC powered or battery powered. The remote control 110 is configured to control all the depicted Receiver/Controllers, by controlling each Output Zone individually and changing all outputs together for that specific output Zone. In the depicted example, the illuminated tree 120 is configured with the single-zone receiver controller 135 to govern the illuminated tree 120 illumination in collaboration with the remote control 110. In the depicted example, the single-zone receiver controller 135 is configured with AC power 1015 and AC/DC HI/LO adapter 1020 to govern the lighting in the illuminated tree 120 including the dual color LEDs 1010. In the illustrated embodiment, the illuminated wreath 125 is configured with the battery-powered single-zone receiver controller 150 in collaboration with the remote control 110 to govern the illuminated wreath 125 illumination including the dual color LEDs 1010 and the LED bow 125. In the depicted example, the illuminated candy cane 130 is configured with the single-zone receiver controller 165 to govern the illuminated candy cane 130 illumination in collaboration with the remote control 110. In the depicted example, the single-zone receiver controller 165 is configured with AC power 1015 and AC/DC HI/LO adapter 1020 to govern the lighting in the illuminated candy cane 130 including the dual color LEDs 1010.

Figure 11:
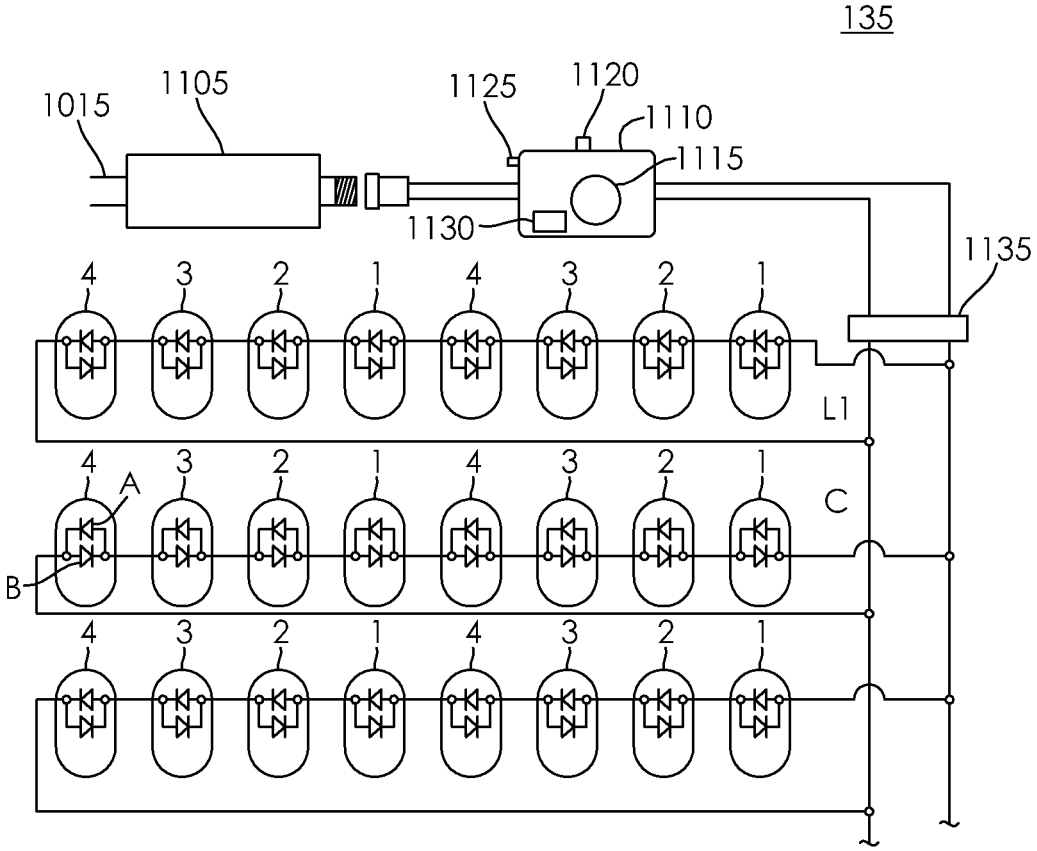
FIG. 11 depicts a schematic view of an embodiment single output zone Receiver/controller configured with an AC/DC HMO adapter to control a back to back dual color LED light string.

FIG. 11 depicts a schematic view of an embodiment single output zone Receiver/controller configured with an AC/DC HMO adapter to control a back to back dual color LED light string. In FIG. 11, the illustrated embodiment single output zone Receiver/controller 135 includes AC power 1015 and the AC/DC HMO adapter configured with the transformer 1105. In the depicted embodiment, the exemplary single output zone Receiver/controller 135 is configured to control a back to back dual color LED light string system that may be used, for example, with the display items of FIG. 10. In the illustrated embodiment, the exemplary single output zone Receiver/controller 135 design includes Receiver/Control 1110. In the depicted embodiment, the Receiver/Control 1110 is configured with the Zone selector switch 1125 and pattern switch 1115. The illustrated embodiment single output zone Receiver/controller 135 may be operably configured with decorative lights to govern illumination in lighting displays by the Output Control L/R/A switch 1120, and Zone Display switches 1130. In the depicted embodiment, the depicted zone control outputs may be coupled with decorative lighting via connectors 1135.

Figure 12:
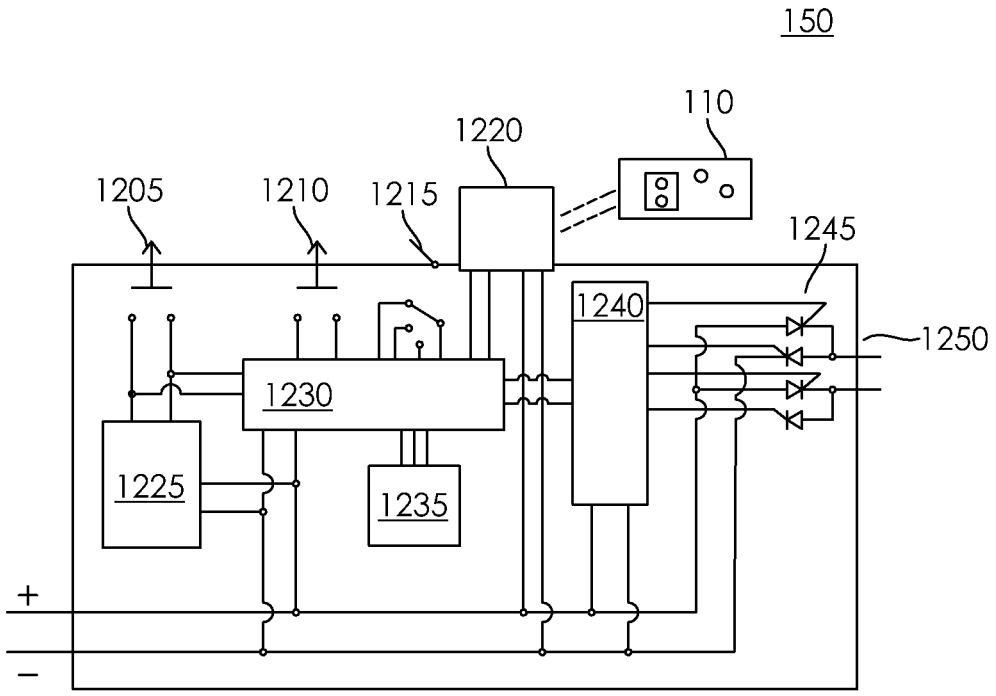
FIG. 12 depicts a circuit block diagram view of an embodiment single output zone Receiver/Controller, configured to power strings of back to back dual color LEDs used typically with Christmas decorations and Christmas trees.

FIG. 12 depicts a circuit block diagram view of an embodiment single output zone Receiver/Controller, configured to power strings of back to back dual color LEDs used typically with Christmas decorations and Christmas trees. In the depicted embodiment, the output 1250 section of the exemplary single output zone Receiver/Controller 150 includes output semiconductors 1245 configured to amplify the output current and voltage to power LED light strings that may be connected to the output 1250. In the illustrated example, LED light strings that may be connected to the output 1250 receive bias signals from the Output Driver 1240 section. In the illustrated embodiment, the Output Driver 1240 section decodes the information from the Electronic output selector 1230 (substantially an electronic flip flop switch) that connects the Output Driver 1240 section to either the Receiver 1220 section or the Local Sequence Control 1225, wherein either the Output control L/R/A 1215 is set to have only the Local Sequence Control 1225 signals, or to pass on only the signals received from the remote control 110 from the Receiver 1220 section, or, in some examples, from either the Local Sequence Control 1225 or from the Receiver 1220, which ever was the last signal received from either section. In the depicted embodiment, the Zone Selector Switch 1210 configures the output 1250 to one of the possible Output Zone numbers. In the illustrated embodiment, the Zone display 1235 readout identifies the zone number of the output. In the illustrated embodiment, the exemplary Receiver/Controller 150 includes the Local Sequence Control 1225 section preprogrammed with displays for back to back dual color LED light strings. In an illustrative example, each preprogrammed display may be selected by advancing the Local Pattern Switch 1205 including the last sequence "Off". In the depicted embodiment, the exemplary Receiver/Controller 150 includes the receiver 1220 to accept signals from the remote control 110. In various embodiments, the receiver 1220 may be configured to communicate with the remote control 110 via a WiFi, Infrared, or RF signal.

Figure 13:
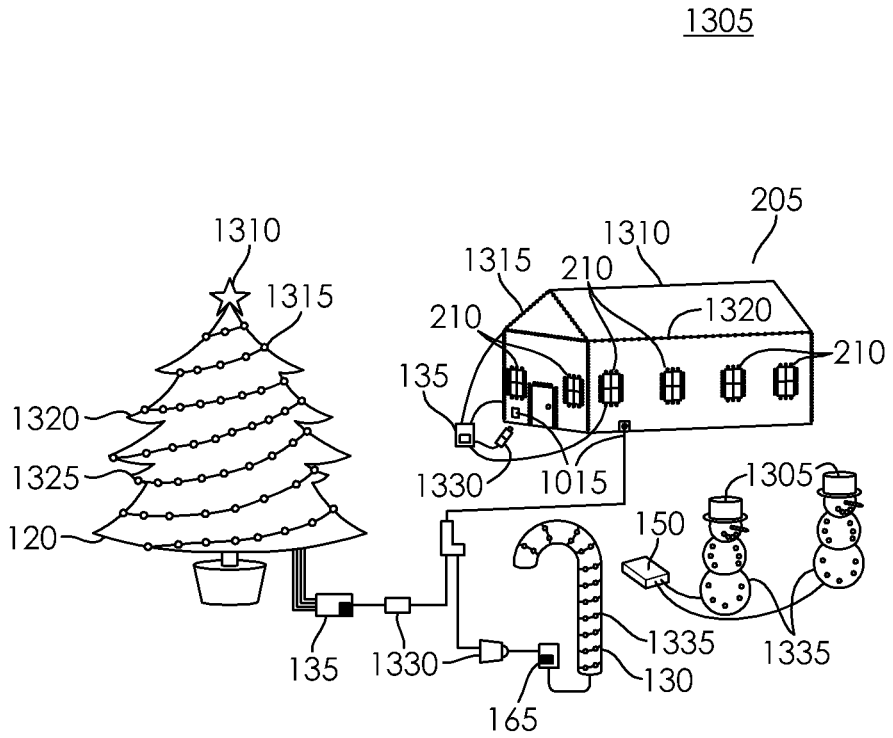
FIG. 13 depicts an exemplary embodiment group of Christmas dual color LED display items including Multi-Zoned output display items and a single Output Zone display item (Candy Cane).

FIG. 13 depicts an exemplary embodiment group of Christmas dual color LED display items including Multi-Zoned output display items and a single Output Zone display item (Candy Cane). In FIG. 13, the illustrated embodiment group of Christmas dual color LED display items 1305 includes the Multi-Zoned output display illuminated tree 120, the Multi-Zoned output display illuminated house 205, and the Multi-Zoned output display illuminated snowmen, configured with the single Output Zone display illuminated candy cane 130. In the depicted example, each of the Multi-Zoned output display illuminated tree 120, the Multi-Zoned output display illuminated house 205, and the Multi-Zoned output display illuminated snowmen, are configured with a multi-zone receiver/controller governing illumination in the respective controlled display item. In the illustrated embodiment, the lights governed by the receiver/controller configured with the illuminated tree 120 include the LEDs 1310 in zone 1, the dual color LEDs 1315 in zone 2, the dual color LEDs 1320 in zone 3, and dual color LEDs 1325 in zone 4, wherein the zones are configured in the zone controller for the illuminated tree 120. In the depicted example, the multi-zone receiver/controller configured with the illuminated tree 120 is configured with the adapter 1330 coupled with AC power 1015 at the house 205. In the illustrated example, the Multi-Zoned output display illuminated house 205 is also configured with a multi-zone receiver/controller connected to an adapter 1330 coupled with AC power 1015 at the house 205. In the depicted embodiment, the lights governed by the receiver/controller configured with the house 205 include the LEDs 1310 in zone 1, the dual color LEDs 1315 in zone 2, the dual color LEDs 1320 in zone 3, and dual color LEDs 1325 in zone 4, wherein the zones are configured in the zone controller for the house 205. In the depicted example, the illuminated candy cane 130 and the illuminated snowmen are configured to present a coordinated display in three zones, based on collaboratively configured receiver controllers in each of the illuminated candy cane 130 and illuminated snowmen display items. In the illustrated example, the single Output Zone display illuminated candy cane 130 is configured with a single output zone receiver/controller governing illumination in the configured display item for the dual color LEDs 1335 in zone 1, with zone 2 and zone 3 displayed with dual color LEDs 1335 controlled in the illuminated snowmen by a battery powered dual zone receiver/controller. In the illustrated example, the embodiment group of Christmas dual color LED display items 1305 include both AC powered and Battery powered systems. In the illustrated example, the embodiment remote control 110 is configured to control all Receiver/Controllers, by controlling each Output Zone individually and changing all outputs together for that specific output Zone.

Figure 14:
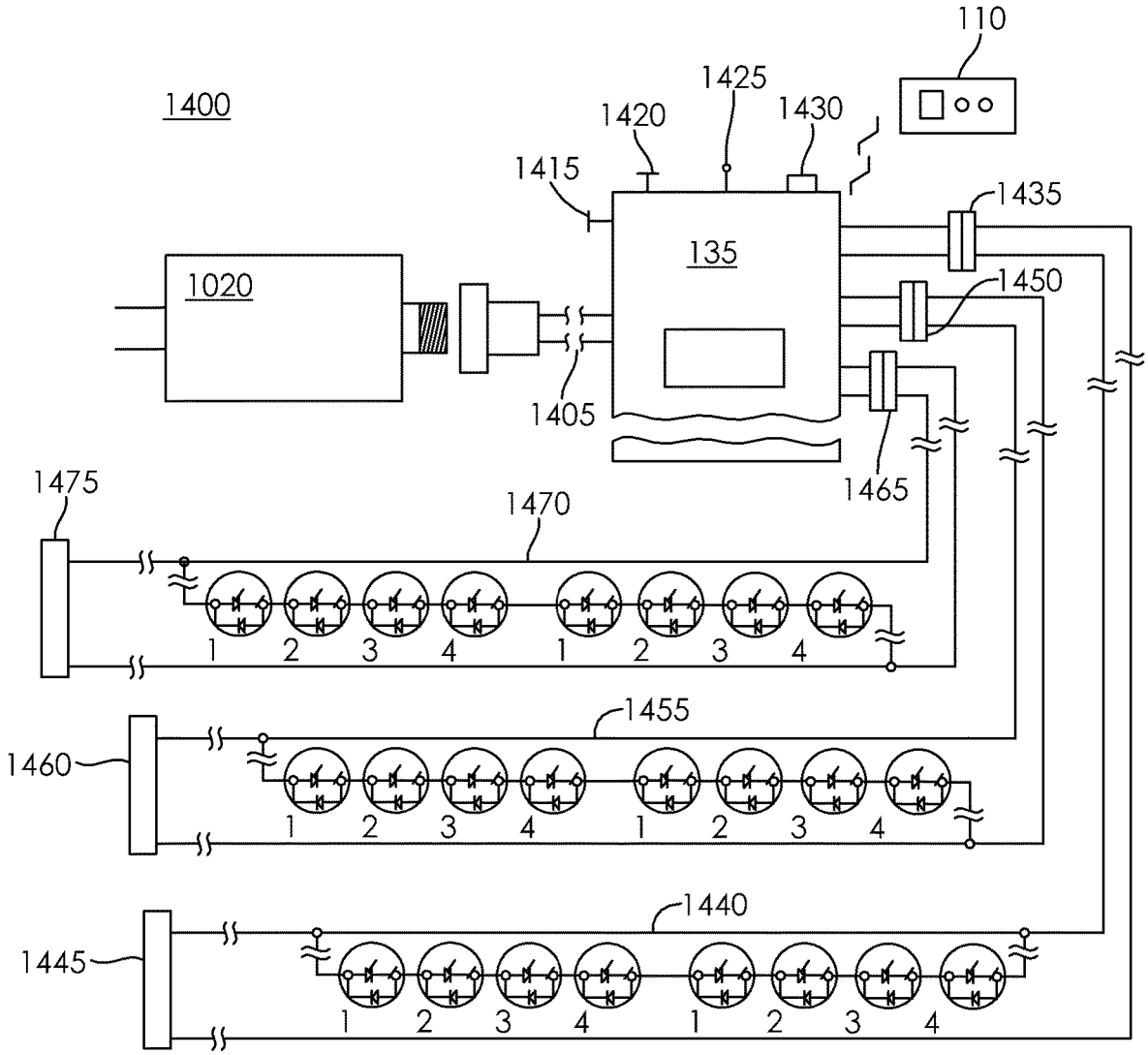
FIG. 14 depicts a schematic view of an embodiment Multi-Zone Output Receiver/Controller configured with an AC/DC HI/LO adapter and back to back dual color LED light strings.

FIG. 14 depicts a schematic view of an embodiment Multi-Zone Output Receiver/Controller configured with an AC/DC HI/LO adapter and back to back dual color LED light strings. In FIG. 14, the depicted embodiment 1400 Multi-Zone Output Receiver/Controller 135 includes the AC/DC HMO adapter 1020 configured with DC coupling 1405 to power the Receiver/Controller 135. In the depicted embodiment, the Receiver/Controller 135 includes the back to back dual color LED light strings 1440, 1455, 1470 respectively connected in Zone 1, Zone 2, Zone 3 to the Receiver/Controller 135 output connectors 1435, 1450, 1465. The depicted back to back dual color LED light strings are exemplary of lights useful with the embodiment display items depicted by FIG. 13. In the depicted example, the LED light string 1440 may be extended by coupling an additional light string to the connector 1445. In the illustrated example, the LED light string 1455 may be extended by coupling an additional light string to the connector 1460. In the depicted example, the LED light string 1470 may be extended by coupling an additional light string to the connector 1475. The depicted Multi-Zone Output Receiver/Controller 135 example includes the Multi-Zone Receiver/Control in communication with the remote control 110. In the illustrated embodiment, the Multi-Zone Output Receiver/Controller 135 includes the Zone selector switch 1415, pattern switch 1420, Output Control L/R/A 1425, and Zone Display switches connected to the LED light strings.

Figure 15:
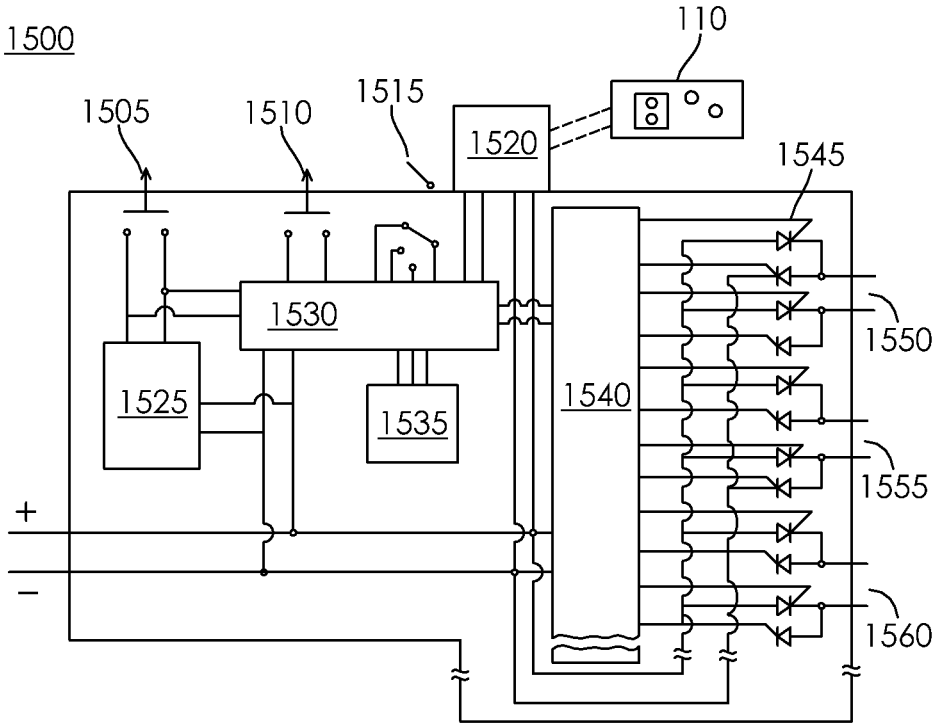
FIG. 15 depicts a circuit block diagram view of a Multi-Zone Output, Receiver/Controller, configured to power strings of back to back dual color LEDs light strings used typically with Christmas decorations and Christmas trees.

FIG. 15 depicts a circuit block diagram view of a Multi-Zone Output, Receiver/Controller, configured to power strings of back to back dual color LEDs light strings used typically with Christmas decorations and Christmas trees. In FIG. 15, the illustrated embodiment circuit block diagram the Multi-Zone Output Receiver/Controller 1500 is configured to power strings of back to back dual color LEDs light strings useful, for example, with Christmas decorations and Christmas trees. In the depicted embodiment, the Multi-Zone Output Receiver/Controller 1500 output section includes zone 1 output 1550, zone 2 output 1555, and zone 3 output 1560, each configured to power LEDs in their respective zone. In the illustrated embodiment, the Multi-Zone Output Receiver/Controller 1500 includes multiple sets of output semiconductors 1545 configured to amplify the output current and voltage to power LED light strings attached to each output zone. In an illustrative example, the output semiconductors 1545 are configured to receive their bias signals from the Output Driver 1540 section. In the illustrated embodiment, the Multi-Zone Output Receiver/Controller 1500 Output Driver 1540 section decodes the information from the Electronic output selector 1530 (substantially an electronic flip flop switch) that connects the Output Driver 1540 section to either the Receiver 1520 section or the Local Sequence control 1525, wherein either the Output control L/R/A 1515 is set to use only the Local Sequence Control 1525 signals, or, to pass on only the signals received by the Receiver 1520 section from the remote control 110. In an illustrative example, the Output control L/R/A 1515 may be configured to either the Local Sequence Control 1525 or the signal from the Receiver 1520, based on a determination of which signal source provided the last signal received from either section. In the illustrated embodiment, the Multi-Zone Output Receiver/Controller 1500 includes the Zone Selector Switch 1510 configured to set the output to one of the possible Output Zone numbers. In the depicted embodiment, the Multi-Zone Output Receiver/Controller 1500 includes the Zone display readout 1535 configured to identify the zone number of the output. In the illustrated embodiment, the Multi-Zone Output Receiver/Controller 1500 includes the Local Sequence Control section 1525 configured with preprogrammed displays for the back to back dual color LED light strings, wherein each display may be selected by advancing the Local Pattern Switch 1505 including the last sequence "Off."

Figure 16:
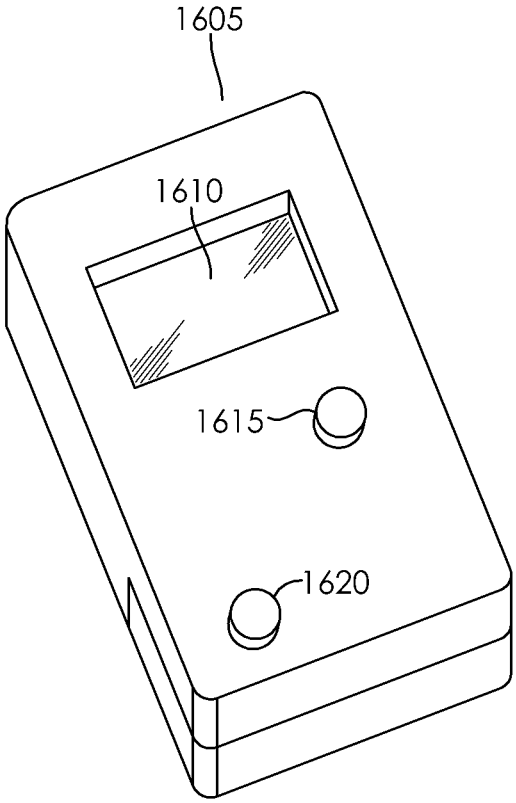
FIG. 16 depicts a front perspective view of an embodiment two button Remote control configured with a Zone read out to indicate the Output Zone.

FIG. 16 depicts a front perspective view of an embodiment two button Remote control configured with a Zone read out to indicate the Output Zone. In FIG. 16, the depicted embodiment multi-zone/sequence remote control unit 1605 is illustrated with a touch screen that may be programmed to display the sequences for the displays and the Output Zones. In the illustrated embodiment, the multi-zone/sequence remote control unit 1605 includes the readout 1610, the sequence switch 1615, and the zone switch 1620. In an illustrative example, the multi-zone/sequence remote control unit 1605 may include a battery compartment. In various embodiments, the depicted remote control unit 1605 may be implemented in a configuration based on the remote control 110 design, depicted at least in FIGS. 1, 7, & 8. In some examples, the multi-zone/sequence remote control unit 1605 may be implemented in a smart phone or other wi-fi device such as an "ECHO" or "ASCERI" type, with a mobile software application that may provide multiple choices for the control of the multiple Receiver/controller devices. In the illustrated embodiment, the exemplary two button Remote control 1605 Zone readout 1610 indicates the Output Zone controlled by the sequence switch 1615, and the readout 1610 screen also displays the sequence number that is being commanded for that Output Zone. In the depicted example, the two buttons sequence the Output zone and the display sequence.

Figure 17:
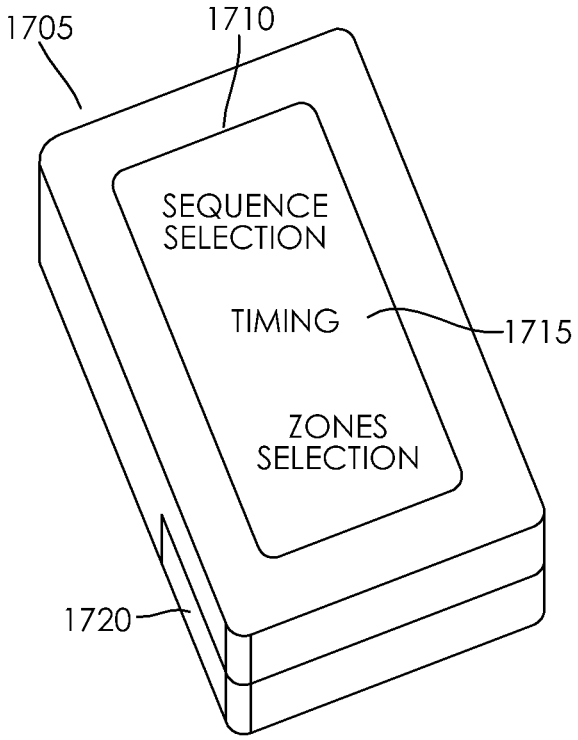
FIG. 17 depicts a front perspective view of an embodiment remote control unit configured with a touch screen programmed to display exemplary sequences for displays and Output Zones.

FIG. 17 depicts a front perspective view of an embodiment remote control unit configured with a touch screen programmed to display exemplary sequences for displays and Output Zones. In FIG. 17, the depicted embodiment smart remote control unit 1705 includes touch screen 1710. In the illustrated embodiment, the smart remote control unit 1705 touch screen 1710 user interface features include sequence selection, timing, and zone selection. In an illustrative example, the smart remote control unit 1705 may include a battery compartment. In some embodiments, the depicted smart remote control unit 1705 may be implemented in a configuration based on the remote control 110 design, depicted at least in FIGS. 1, 7, & 8.

Figure 18:
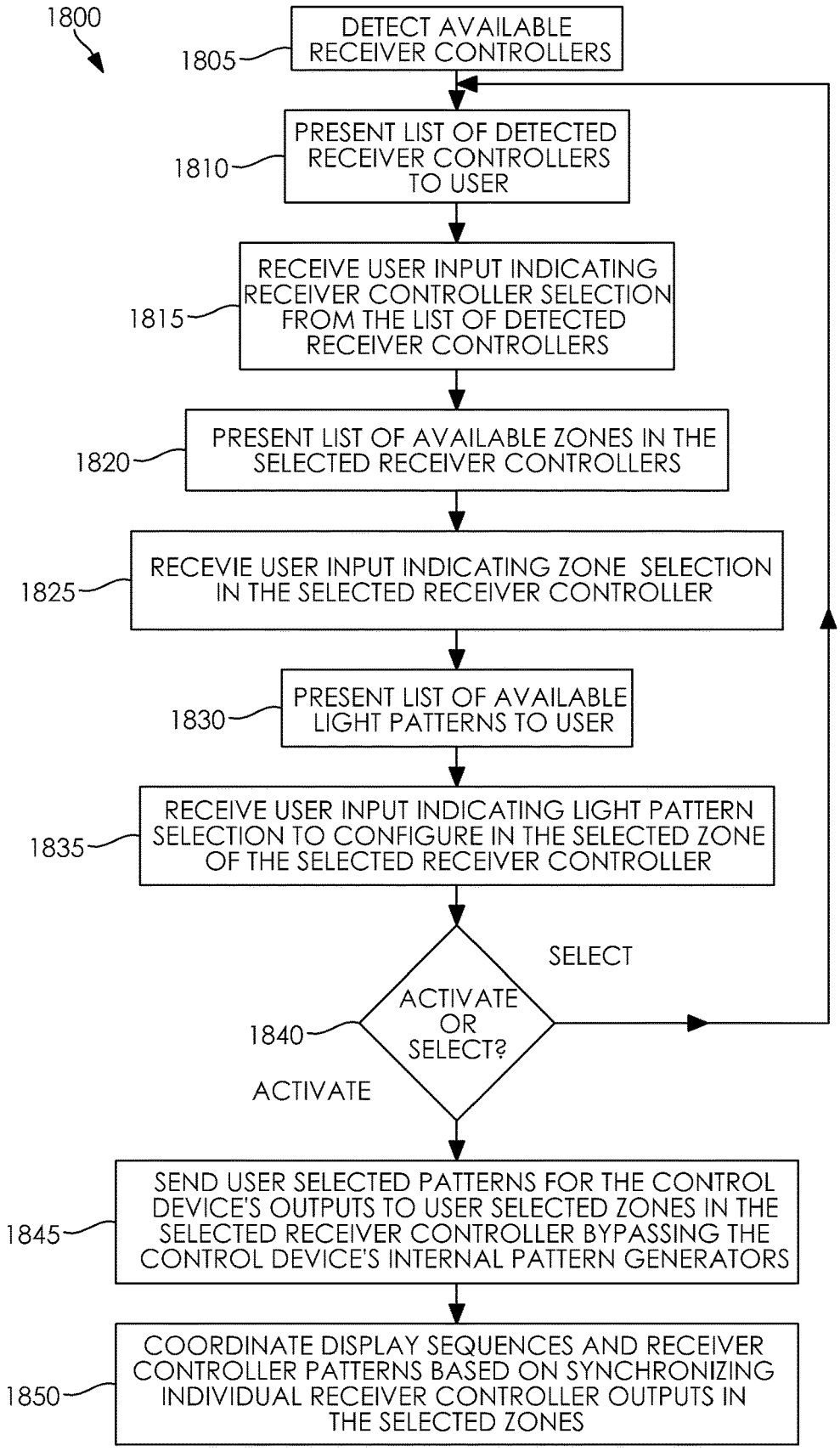
FIG. 18 depicts an illustrative process flow of an exemplary MCRCE (Multi-Control Remote Coordination Engine) embodiment design.

FIG. 18 depicts an illustrative process flow of an exemplary MCRCE (Multi-Control Remote Coordination Engine) embodiment design. The method depicted in FIG. 18 is given from the perspective of the MCRCE (Multi-Control Remote Coordination Engine) 825 implemented via processor-executable program instructions executing on the remote control 110 processor 805, depicted in FIG. 8. In the illustrated embodiment, the MCRCE 825 executes as program instructions on the processor 805 configured in the MCRCE 825 host remote control 110, depicted in at least FIG. 1, FIG. 7, and FIG. 8. In some embodiments, the MCRCE 825 may execute as a cloud service communicatively and operatively coupled with system services, hardware resources, or software elements local to and/or external to the MCRCE 825 host remote control 110. The depicted method 1800 begins at step 1805 with the processor 805 detecting available receiver controllers. In some embodiments, the processor 805 may detect available receiver controllers determined as a function of an electronic message received by the processor 805, wherein the received message may indicate one or more available receiver controller. Then, the method continues at step 1810 with the processor 805 presenting a list of detected receiver controllers to a user. In various examples, the list of detected receiver controllers may include available receiver controllers. In some designs, the list of detected receiver controllers may include receiver controller options, capabilities, location, or assignment. For example, the list of available receiver controllers may identify lighting pattern or lighting sequence capabilities of the receiver controllers in the list. In an illustrative example, the processor 805 may present the list of detected receiver controllers in a user interface. In some examples, the user interface may be a mobile device software application operable by tactile, visible, or audible activity captured by the processor 805. The method continues at step 1815 with the processor 805 receiving user input indicating a receiver controller selection from the list of detected receiver controllers. Then, the method continues at step 1820 with the processor 805 presenting a list of available zones in the selected receiver controller to the user. Then, the method continues at step 1825 with the processor 805 receiving user input indicating zone selection in the selected receiver controller. Then, the method continues at step 1830 with the processor 805 presenting available light patterns or light sequences to the user. Then, the method continues at step 1835 with the processor 805 receiving user input indicating light pattern or light sequence selection to configure in the selected zone of the selected receiver controller. At step 1840, the processor 805 performs a test based on user input received by the processor 805 to determine if the selected light pattern or sequence should be activated in the selected receiver controller, or if receiver controller, zone, or pattern selection should continue. Upon a determination by the processor 805 at step 1840 that receiver controller, zone, or pattern selection should continue, the method continues at step 1810 with the processor 805 presenting a list of detected receiver controllers to a user. Upon a determination by the processor 805 at step 1840 that the selected light pattern or sequence should be activated in the selected receiver controller, the method continues at step 1845 with the processor 805 sending user selected patterns for the control device's outputs to the user selected zones in the selected receiver controllers bypassing the control device's internal pattern generators. Then, the method continues at step 1850 with the processor 805 coordinating display sequences and receiver controller patterns based on synchronizing individual receiver controller outputs in the selected zones. In various implementations, the method may repeat.

Figure 19:
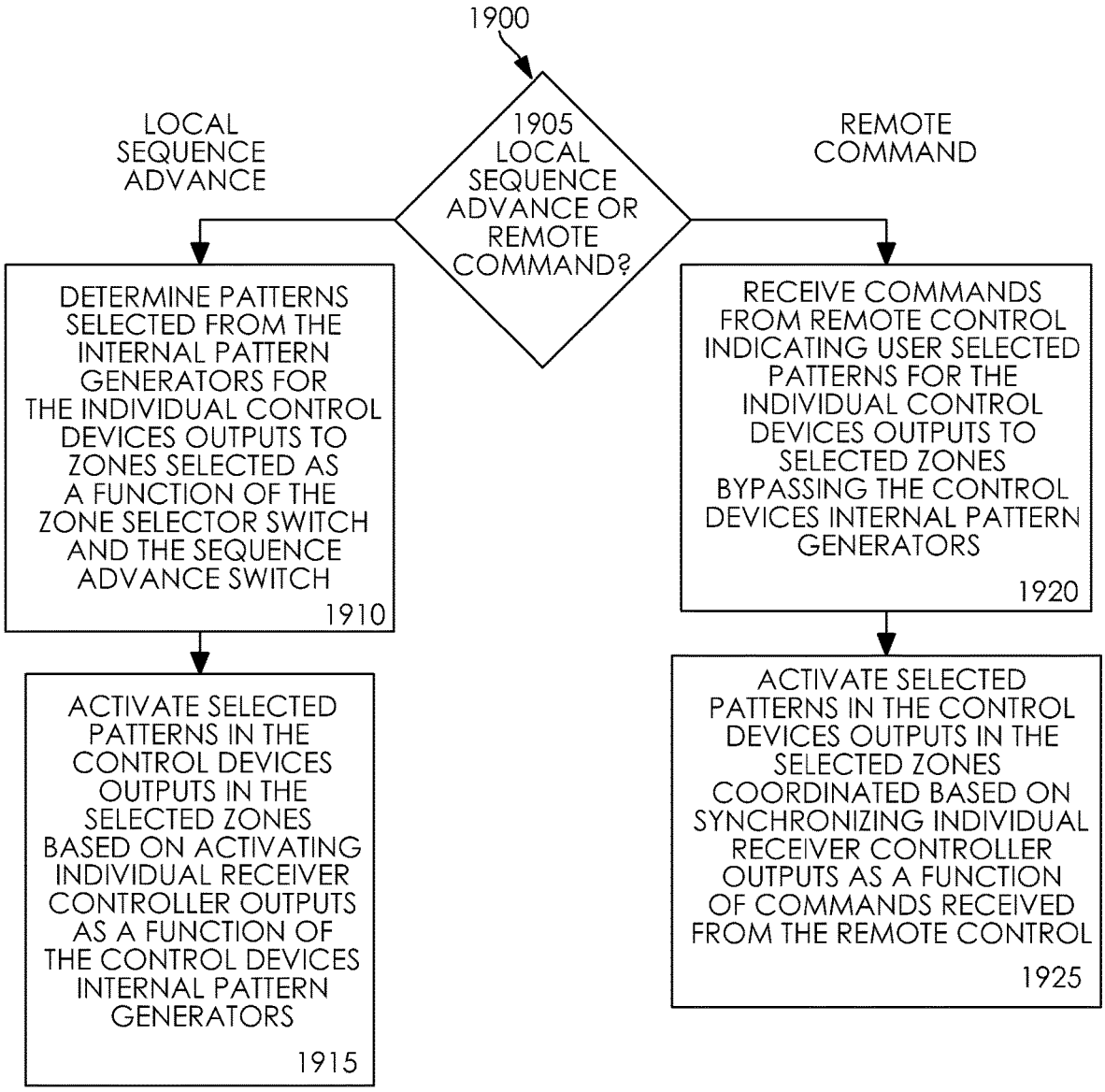
FIG. 19 depicts an illustrative process flow of an exemplary RCPAE (Receiver Controller Pattern Activation Engine) embodiment design.

FIG. 19 depicts an illustrative process flow of an exemplary RCPAE (Receiver Controller Pattern Activation Engine) embodiment design. The method depicted in FIG. 19 is given from the perspective of the RCPAE (Receiver Controller Pattern Activation Engine) 925 implemented via processor-executable program instructions executing on the receiver controller 135 processor 905, depicted in FIG. 9. In various examples, the depicted embodiment receiver controller 135 design also illustrates exemplary design of embodiment receiver controller 150 and embodiment receiver controller 165, also depicted at least in FIG. 1 and FIG. 7. In the illustrated embodiment, the RCPAE 925 executes as program instructions on the processor 905 configured in the RCPAE 925 host receiver controller 135, receiver controller 150, or receiver controller 165, depicted in at least FIG. 1, FIG. 7, and FIG. 9. In some embodiments, the RCPAE 925 may execute as a cloud service communicatively and operatively coupled with system services, hardware resources, or software elements local to and/or external to the RCPAE 925 host receiver controller 135, receiver controller 150, or receiver controller 165. The depicted method 1900 begins at step 1905 with the processor 905 performing a test to determine if illumination should be controlled by local sequence advance or remote command, based on local configuration read by the processor 905 or communication received by the processor 905. In some designs, the processor 905 may receive an electronic message including a remote command. In various examples, the remote command may indicate user selected patterns should be activated in the zone controller outputs. In some embodiments, the remote command may indicate a combination of user selected patterns and the zone controller's internal pattern generators should be activated in the zone controller outputs. In an illustrative example, local configuration read by the processor 905 may include switch or button settings, user interface option selection, or live user input to the processor 905. Upon a determination at step 1905 by the processor 905 that illumination should be controlled by local sequence advance, the method continues at step 1910 with the processor 905 determining patterns selected from the internal pattern generators for the individual zone controller outputs to zones selected as a function of the zone selector switch and the sequence advance switch. Then, the method continues at step 1915 with the processor 905 activating the selected patterns in the zone controller outputs in the selected zones based on activating individual receiver controller outputs as a function of the control devices internal pattern generators. Upon a determination at step 1905 by the processor 905 that illumination should be controlled by remote command, the method continues at step 1920 with the processor 905 receiving commands from a remote control indicating user selected patterns for the individual zone controller outputs to the selected zones, bypassing the zone controllers internal pattern generators. Then, the method continues at step 1925 with the processor 905 activating the selected patterns in the zone controllers outputs in the selected zones coordinated based on synchronizing individual zone controller outputs as a function of commands received from a remote control. In various implementations, the method may repeat.

Although various embodiments have been described with reference to the Figures, other embodiments are possible. For example, some embodiment implementations include a new dual color control system and remote control that allows highly flexible control of multiple display decorative items individually or in coordination with local or remote control of displays as well as multi-displays on a single item like a tree. Various embodiments may advantageously provide a multi-zone, multi-control dual color remote control system configured to provide flexible, reconfigurable decorative lighting patterns and sequences in multiple zones for special occasions and holidays of various types, without complicated or tedious rewiring of prior art lighting displays and controls.

Various embodiment designs in accordance with the present disclosure may advantageously provide unique and novel features including, for example:

- In some embodiments, each individual Receiver/Controller device may include a Zone Selector Switch that gives each of its outputs an individual identity, herein and in figures, called "Output Zones", typically there are one of nine Output Zones identity's or numbers, for each output although there could be a larger multiplicity of individual Output Zones per Receiver/Controller.
- In various embodiments, each individual Received/Controller box's outputs to the LED strings can be made to be controlled by its local Sequence Advance push button switch or made to follow the commands from the remote control or to be automatically controlled by the local Sequence Advance push button switch or the remote-control device which ever was the last to give a command.
- Some embodiment individual Receiver/Controller designs may include an Output Control L/R/A switch that allows the Receiver/Controller device to be, only controlled locally (L), or only by the remote control (R) or automatically (A) switch control to the last sequence signal sent from the remote control or the local controller sequence button, adding even greater flexibility to the display system.
- In an example illustrative of some embodiment implementations' design and usage, when the Remote Control controls the Output Zone of an individual Receiver/Controller and the sequence commanded involves a timer function for the display the individual Receiver/Controller device that are set to that specific Output Zone, all Receiver/Controller change the outputs and dual color LEDs display patterns at the same time because they are following the same timer in the Remote Control not their own individual timers. (again, for reference the attached video labeled 1 zone one control mp4 shows all 3 display areas outputs being controlled by the single timer that would be in the remote control unit.)
- In an example illustrative of various embodiment implementations' design and usage, when individual Receiver/Controller devices have their Output Zone identity set to the same Output Zone number, they will follow the same remote-control signal for that Output Zone identifier. In such an example, one result is that a display could have several control boxes that have the same Output Zone identifier while other control boxes could have their own different Output Zone identifier or several on the same second Output Zone identifier, resulting in a multiplicity of display variations.
- In some embodiment implementation designs, individual Receiver/Controller devices may include multiple Output Zones each corresponding to a specific Output Zone identifier number, and each output can be changed to different Output Zone identifier by the Output Zone selector switch.

In various scenarios exemplary of various embodiments' design and usage, a multi-Output Zone Receiver/Controller may be configured to permit a single display item to provide a multiplicity of zones on that display to allow a variety of display patterns on the same display item, such as, for example, a Christmas tree, so that the Receiver/Controller may be commanded by the remote control to have all output zones display the same pattern or change patterns on sequence to provide a cascading effect as example or a multiplicity of variations. In some examples, a tree with multiple zones may be controlled separately by the same controller or remote to have their tree zones display the same or different patterns.

Various embodiment implementations in accordance with the present disclosure correct prior art deficiencies and permit greater flexibility than existing solutions. Some embodiment designs define two Receiver/Control devices with their Remote-Control units. In an example illustrative of various embodiments' design and usage, the first Receiver/Controller may have a single two conductor output to power the dual color back to back LED light strings, with forward or reverse current direction. In this example illustrative of some embodiment designs, the second Receiver/Control device may have a multiplicity of two conductor outputs to power their dual color back to back LED light strings, with forward or reverse current direction. Some embodiment designs may include a remote control that provides the patterns for the individual control devices outputs bypassing the control devices internal pattern generators to provide coordinated or specific display sequences to the individual controller outputs.

In some embodiment designs, a single output Receiver/Controller device may include several control options for and a multiplicity of displays for its dual color light strings when used with other similar single and multiple output Receiver/Controller dual color LED light string display items.

Various embodiment Multiple Output Receiver/Controller device designs may include a multiplicity of patterns options, and control options that can be used for its own multiple connected dual color LED light strings on a single display item or with a group of other single and multiple output Receiver/Controller dual color LED light string display systems.

In some scenarios exemplary of prior art design and usage, prior art remote controls may act in the same manner as the push button on a prior art control box, causing the LED light strings display to change with the pressing of the remote control button to advance the preprogrammed steps to make the next pattern display that is in the control box not in the remote control itself. Such a prior art system of remote control to individual controls may have various limitations, including:

In some prior art implementations, all individual control boxes are the same and all respond to the received control signals to advance at the same time, however, internal timers in the individual controls vary slightly based on a variety of factors resulting in display pattern of the individual display items not always, changing at the same time. This results in potentially unattractive displays. (Video labeled 3 individual zones mp4 for reference purposes only, shows this on household outside decorations left side, middle and right side each independent sequencing clear to multicolor) (video labeled 2 individual zones mp4 shows a middle and left side on one controller and right side on another same pattern selection)

In various prior art designs, if the individual display items are running different patterns, they cannot be made to display the same patterns by the remote control, unless they are manually set on the same pattern, after which they will on the same display pattern but timer displays will not be in sync as the individual timer's variation will cause the display items to vary in timing, as shown in the above listed videos.

Some prior art individual control boxes with their LED strings do not act in coordinated fashion and lack flexibility.

Existing or prior art "Back to Back" dual color Control Systems, typically have a control box with a preprogrammed number of sequences that are displayed one at a time with each press of the push button switch on the control box.

In an illustrative example, a different type of Control System with Remote Control may be advantageous over prior art systems for operation of Low Voltage, "Back to Back LED" Dual Color light strings as well as LED light strings with more than one set of "Back to Back" LEDs in one bulb decorative systems in the future.

In the Summary above and in this Detailed Description, and the Claims below, and in the accompanying drawings, reference is made to particular features of various embodiments of the invention. It is to be understood that the disclosure of embodiments of the invention in this specification includes all possible combinations of such particular features. For example, where a particular feature is disclosed in the context of a particular aspect or embodiment of the invention, or a particular claim, that feature can also be used—to the extent possible—in combination with and/or in the context of other particular aspects and embodiments of the invention, and in the invention generally.

While multiple embodiments are disclosed, still other embodiments of the present invention will become apparent to those skilled in the art from this detailed description. The invention is capable of myriad modifications in various obvious aspects, all without departing from the spirit and scope of the present invention. Accordingly, the drawings and descriptions are to be regarded as illustrative in nature and not restrictive.

It should be noted that the features illustrated in the drawings are not necessarily drawn to scale, and features of one embodiment may be employed with other embodiments as the skilled artisan would recognize, even if not explicitly stated herein. Descriptions of well-known components and processing techniques may be omitted so as to not unnecessarily obscure the embodiments.

In the present disclosure, various features may be described as being optional, for example, through the use of the verb "may;", or, through the use of any of the phrases: "in some embodiments," "in some implementations," "in some designs," "in various embodiments," "in various implementations,", "in various designs," "in an illustrative example," or "for example;" or, through the use of parentheses. For the sake of brevity and legibility, the present disclosure does not explicitly recite each and every permutation that may be obtained by choosing from the set of optional features. However, the present disclosure is to be interpreted as explicitly disclosing all such permutations. For example, a system described as having three optional features may be embodied in seven different ways, namely with just one of the three possible features, with any two of the three possible features or with all three of the three possible features.

In various embodiments, elements described herein as coupled or connected may have an effectual relationship realizable by a direct connection or indirectly with one or more other intervening elements.

In the present disclosure, the term "any" may be understood as designating any number of the respective elements, i.e. as designating one, at least one, at least two, each or all of the respective elements. Similarly, the term "any" may be understood as designating any collection(s) of the respective elements, i.e. as designating one or more collections of the respective elements, a collection comprising one, at least one, at least two, each or all of the respective elements. The respective collections need not comprise the same number of elements.

While various embodiments of the present invention have been disclosed and described in detail herein, it will be apparent to those skilled in the art that various changes may be made to the configuration, operation and form of the invention without departing from the spirit and scope thereof. In particular, it is noted that the respective features of embodiments of the invention, even those disclosed solely in combination with other features of embodiments of the invention, may be combined in any configuration excepting those readily apparent to the person skilled in the art as nonsensical. Likewise, use of the singular and plural is solely for the sake of illustration and is not to be interpreted as limiting.

In the present disclosure, all embodiments where "comprising" is used may have as alternatives "consisting essentially of," or "consisting of." In the present disclosure, any method or apparatus embodiment may be devoid of one or more process steps or components. In the present disclosure, embodiments employing negative limitations are expressly disclosed and considered a part of this disclosure.

Certain terminology and derivations thereof may be used in the present disclosure for convenience in reference only and will not be limiting. For example, words such as "upward," "downward," "left," and "right" would refer to directions in the drawings to which reference is made unless otherwise stated. Similarly, words such as "inward" and "outward" would refer to directions toward and away from, respectively, the geometric center of a device or area and designated parts thereof. References in the singular tense include the plural, and vice versa, unless otherwise noted.

The term "comprises" and grammatical equivalents thereof are used herein to mean that other components, ingredients, steps, among others, are optionally present. For example, an embodiment "comprising" (or "which comprises") components A, B and C may consist of (i.e., contain only) components A, B and C, or may contain not only components A, B, and C but also contain one or more other components.

Where reference is made herein to a method comprising two or more defined steps, the defined steps can be carried out in any order or simultaneously (except where the context excludes that possibility), and the method can include one or more other steps which are carried out before any of the defined steps, between two of the defined steps, or after all the defined steps (except where the context excludes that possibility).

The term "at least" followed by a number is used herein to denote the start of a range beginning with that number (which may be a range having an upper limit or no upper limit, depending on the variable being defined). For example, "at least 1" means 1 or more than 1. The term "at most" followed by a number (which may be a range having 1 or 0 as its lower limit, or a range having no lower limit, depending upon the variable being defined). For example, "at most 4" means 4 or less than 4, and "at most 40%" means 40% or less than 40%. When, in this specification, a range is given as "(a first number) to (a second number)" or "(a first number)–(a second number)," this means a range whose limit is the second number. For example, 25 to 100 mm means a range whose lower limit is 25 mm and upper limit is 100 mm.

Many suitable methods and corresponding materials to make each of the individual parts of embodiment apparatus are known in the art. According to an embodiment of the present invention, one or more of the parts may be formed by machining, 3D printing (also known as "additive" manufacturing), CNC machined parts (also known as "subtractive" manufacturing), and injection molding, as will be apparent to a person of ordinary skill in the art. Metals, wood, thermoplastic and thermosetting polymers, resins and elastomers as may be described herein-above may be used. Many suitable materials are known and available and can be selected and mixed depending on desired strength and flexibility, preferred manufacturing method and particular use, as will be apparent to a person of ordinary skill in the art.

Any element in a claim herein that does not explicitly state "means for" performing a specified function, or "step for" performing a specific function, is not to be interpreted as a "means" or "step" clause as specified in 35 U.S.C. § 112 (f). Specifically, any use of "step of" in the claims herein is not intended to invoke the provisions of 35 U.S.C. § 112 (f). Elements recited in means-plus-function format are intended to be construed in accordance with 35 U.S.C. § 112 (f).

Recitation in a claim of the term "first" with respect to a feature or element does not necessarily imply the existence of a second or additional such feature or element.

The phrases "connected to," "coupled to" and "in communication with" refer to any form of interaction between two or more entities, including mechanical, electrical, magnetic, electromagnetic, fluid, quantum, and thermal interaction. Two components may be functionally coupled to each other even though they are not in direct contact with each other. The term "abutting" refers to items that are in direct physical contact with each other, although the items may not necessarily be attached together.

The word "exemplary" is used herein to mean "serving as an example, instance, or illustration." Any embodiment described herein as "exemplary" is not necessarily to be construed as preferred or advantageous over other embodiments. While the various aspects of the embodiments are presented in drawings, the drawings are not necessarily drawn to scale unless specifically indicated.

Reference throughout this specification to "an embodiment" or "the embodiment" means that a particular feature, structure or characteristic described in connection with that embodiment is included in at least one embodiment. Thus, the quoted phrases, or variations thereof, as recited throughout this specification are not necessarily all referring to the same embodiment.

Similarly, it should be appreciated that in the above description of embodiments, various features are sometimes grouped together in a single embodiment, Figure, or description thereof for the purpose of streamlining the disclosure. This method of disclosure, however, is not to be interpreted as reflecting an intention that any claim in this or any application claiming priority to this application require more features than those expressly recited in that claim. Rather, as the following claims reflect, inventive aspects may lie in a combination of fewer than all features of any single foregoing disclosed embodiment. Thus, the claims following this Detailed Description are hereby expressly incorporated into this Detailed Description, with each claim standing on its own as a separate embodiment. This disclosure includes all permutations of the independent claims with their dependent claims.

According to an embodiment of the present invention, the system and method may be accomplished through the use of one or more computing devices. As depicted, for example, at least in FIG. 1, FIG. 7, FIG. 8, and FIG. 9, one of ordinary skill in the art would appreciate that an exemplary system appropriate for use with embodiments in accordance with the present application may generally include one or more of a Central processing Unit (CPU), Random Access Memory (RAM), a storage medium (e.g., hard disk drive, solid state drive, flash memory, cloud storage), an operating system (OS), one or more application software, a display element, one or more communications means, or one or more input/output devices/means. Examples of computing devices usable with embodiments of the present invention include, but are not limited to, proprietary computing devices, personal computers, mobile computing devices, tablet PCs, mini-PCs, servers or any combination thereof. The term computing device may also describe two or more computing devices communicatively linked in a manner as to distribute and share one or more resources, such as clustered computing devices and server banks/farms. One of ordinary skill in the art would understand that any number of computing devices could be used, and embodiments of the present invention are contemplated for use with any computing device.

In various embodiments, communications means, data store(s), processor(s), or memory may interact with other components on the computing device, in order to effect the provisioning and display of various functionalities associated with the system and method detailed herein. One of ordinary skill in the art would appreciate that there are numerous configurations that could be utilized with embodiments of the present invention, and embodiments of the present invention are contemplated for use with any appropriate configuration.

According to an embodiment of the present invention, the communications means of the system may be, for instance, any means for communicating data over one or more networks or to one or more peripheral devices attached to the system. Appropriate communications means may include, but are not limited to, circuitry and control systems for providing wireless connections, wired connections, cellular connections, data port connections, Bluetooth connections, or any combination thereof. One of ordinary skill in the art would appreciate that there are numerous communications means that may be utilized with embodiments of the present invention, and embodiments of the present invention are contemplated for use with any communications means.

Throughout this disclosure and elsewhere, block diagrams and flowchart illustrations depict methods, apparatuses (i.e., systems), and computer program products. Each element of the block diagrams and flowchart illustrations, as well as each respective combination of elements in the block diagrams and flowchart illustrations, illustrates a function of the methods, apparatuses, and computer program products. Any and all such functions ("depicted functions") can be implemented by computer program instructions; by special-purpose, hardware-based computer systems; by combinations of special purpose hardware and computer instructions; by combinations of general purpose hardware and computer instructions; and so on—any and all of which may be generally referred to herein as a "circuit," "module," or "system."

While the foregoing drawings and description may set forth functional aspects of the disclosed systems, no particular arrangement of software for implementing these functional aspects should be inferred from these descriptions unless explicitly stated or otherwise clear from the context.

Each element in flowchart illustrations may depict a step, or group of steps, of a computer-implemented method. Further, each step may contain one or more sub-steps. For the purpose of illustration, these steps (as well as any and all other steps identified and described above) are presented in order. It will be understood that an embodiment can contain an alternate order of the steps adapted to a particular application of a technique disclosed herein. All such variations and modifications are intended to fall within the scope of this disclosure. The depiction and description of steps in any particular order is not intended to exclude embodiments having the steps in a different order, unless required by a particular application, explicitly stated, or otherwise clear from the context.

Traditionally, a computer program consists of a sequence of computational instructions or program instructions. It will be appreciated that a programmable apparatus (i.e., computing device) can receive such a computer program and, by processing the computational instructions thereof, produce a further technical effect.

A programmable apparatus may include one or more microprocessors, microcontrollers, embedded microcontrollers, programmable digital signal processors, programmable devices, programmable gate arrays, programmable array logic, memory devices, application specific integrated circuits, or the like, which can be suitably employed or configured to process computer program instructions, execute computer logic, store computer data, and so on. Throughout this disclosure and elsewhere a computer can include any and all suitable combinations of at least one general purpose computer, special-purpose computer, programmable data processing apparatus, processor, processor architecture, and so on.

It will be understood that a computer can include a computer-readable storage medium and that this medium may be internal or external, removable and replaceable, or fixed. It will also be understood that a computer can include a Basic Input/Output System (BIOS), firmware, an operating system, a database, or the like that can include, interface with, or support the software and hardware described herein.

Embodiments of the system as described herein are not limited to applications involving conventional computer programs or programmable apparatuses that run them. It is contemplated, for example, that embodiments of the invention as claimed herein could include an optical computer, quantum computer, analog computer, or the like.

Regardless of the type of computer program or computer involved, a computer program can be loaded onto a computer to produce a particular machine that can perform any and all of the depicted functions. This particular machine provides a means for carrying out any and all of the depicted functions.

Any combination of one or more computer readable medium(s) may be utilized. The computer readable medium may be a computer readable signal medium or a computer readable storage medium. A computer readable storage medium may be, for example, but not limited to, an electronic, magnetic, optical, electromagnetic, infrared, or semiconductor system, apparatus, or device, or any suitable combination of the foregoing. More specific examples (a non-exhaustive list) of the computer readable storage medium would include the following: an electrical connection having one or more wires, a portable computer diskette, a hard disk, a random access memory (RAM), a read-only memory (ROM), an erasable programmable read-only memory (EPROM or Flash memory), an optical fiber, a portable compact disc read-only memory (CD-ROM), an optical storage device, a magnetic storage device, or any suitable combination of the foregoing. In the context of this document, a computer readable storage medium may be any tangible medium that can contain or store a program for use by or in connection with an instruction execution system, apparatus, or device.

Computer program instructions can be stored in a computer-readable memory capable of directing a computer or other programmable data processing apparatus to function in a particular manner. The instructions stored in the computer-readable memory constitute an article of manufacture including computer-readable instructions for implementing any and all of the depicted functions.

A computer readable signal medium may include a propagated data signal with computer readable program code embodied therein, for example, in baseband or as part of a carrier wave. Such a propagated signal may take any of a variety of forms, including, but not limited to, electromagnetic, optical, or any suitable combination thereof. A computer readable signal medium may be any computer readable medium that is not a computer readable storage medium and that can communicate, propagate, or transport a program for use by or in connection with an instruction execution system, apparatus, or device.

Program code embodied on a computer readable medium may be transmitted using any appropriate medium, including but not limited to wireless, wireline, optical fiber cable, RF, etc., or any suitable combination of the foregoing.

The elements depicted in flowchart illustrations and block diagrams throughout the figures imply logical boundaries between the elements. However, according to software or hardware engineering practices, the depicted elements and the functions thereof may be implemented as parts of a monolithic software structure, as standalone software modules, or as modules that employ external routines, code, services, and so forth, or any combination of these. All such implementations are within the scope of the present disclosure.

Unless explicitly stated or otherwise clear from the context, the verbs "execute" and "process" are used interchangeably to indicate execute, process, interpret, compile, assemble, link, load, any and all combinations of the foregoing, or the like. Therefore, embodiments that execute or process computer program instructions, computer-executable code, or the like can suitably act upon the instructions or code in any and all of the ways just described.

The functions and operations presented herein are not inherently related to any particular computer or other apparatus. Various general-purpose systems may also be used with programs in accordance with the teachings herein, or it may prove convenient to construct more specialized apparatus to perform the required method steps. The required structure for a variety of these systems will be apparent to those of skill in the art, along with equivalent variations. In addition, embodiments of the invention are not described with reference to any particular programming language. It is appreciated that a variety of programming languages may be used to implement the present teachings as described herein, and any references to specific languages are provided for disclosure of enablement and best mode of embodiments of the invention. Embodiments of the invention are well suited to a wide variety of computer network systems over numerous topologies. Within this field, the configuration and management of large networks include storage devices and computers that are communicatively coupled to dissimilar computers and storage devices over a network, such as the Internet.

A number of implementations have been described. Nevertheless, it will be understood that various modifications may be made. For example, advantageous results may be achieved if the steps of the disclosed techniques were performed in a different sequence, or if components of the disclosed systems were combined in a different manner, or if the components were supplemented with other components. Accordingly, other implementations are contemplated within the scope of the following claims.

What is claimed is:

1. A process to independently and selectively activate decorative lighting in an illumination control zone, comprising:

configuring a decorative lighting zone with a zone controller adapted to independently control the lighting in the lighting zone;

programming the zone controller to implement a lighting command;

automatically providing a remotely configurable lighting display in the lighting zone based on independently activating the lighting command in the zone controller;

configuring a remote control to communicate with the zone controller;

wherein programming the zone controller to implement the lighting command includes the lighting command being sent from the remote control to the zone controller;

wherein programming the zone controller includes receiving an electronic message including an indication of a zone controller available to be programmed;

sending an electronic message to initiate negotiation among a plurality of remote controls to select one remote control as an illumination control session coordination leader;

receiving an electronic message including an indication of available illumination control session coordination leader candidates; and receiving an electronic message including selection of the remote control as the illumination control session coordination leader.

2. The process of claim 1, wherein the lighting command sent from the remote control to the zone controller indicates a user selected pattern for the individual zone controller output to the selected zone, bypassing the zone controller internal pattern generators.

3. The process of claim 1, wherein the selected patterns in the zone controller outputs in the selected zones are coordinated based on synchronizing individual zone controller outputs as a function of the lighting command sent from the remote control to the zone controller.

4. The process of claim 1, wherein the process further comprises receiving an electronic message comprising the lighting command.

5. The process of claim 1, wherein the lighting command further comprises a lighting pattern.

6. The process of claim 1, wherein the lighting command further comprises a lighting sequence.

7. The process of claim 1, wherein the indication of a zone controller available to be programmed further comprises an indication of a plurality of zone controllers available to be programmed.

8. The process of claim 1, wherein the zone controller further comprises a multiple-zone controller.

9. The process of claim 1, further comprising sending to at least one of the plurality of remote controls an electronic message including a lighting command to be activated in at least one zone controller governed by the at least one of the plurality of remote controls.

10. A decorative lighting control apparatus configured to independently and selectively activate decorative lighting in an illumination control zone, comprising:

a zone controller, comprising:

a first processor;

a wireless communication interface operably coupled with the first processor;

an input/output interface, operably coupled with the first processor, wherein the input/output interface is adapted to selectively and independently power and control a plurality of lighting elements operably coupled with the input/output interface; and, a first memory that is not a transitory propagating signal, the first memory connected to the first processor and encoding computer readable instructions, including processor executable program instructions, the computer readable instructions accessible to the first processor, wherein the processor executable program instructions, when executed by the first processor, cause the first processor to perform operations comprising:

sending an electronic message comprising an indication the zone controller is available to be programmed;

receiving an electronic message comprising an indication of the zone controller to be programmed;

receiving an electronic message comprising a lighting command; and, automatically providing a remotely configurable lighting display in the lighting zone based on independently activating the lighting command in the zone controller; and a remote control, comprising:

a second processor;

a wireless communication interface operably coupled with the second processor; and, a second memory that is not a transitory propagating signal, the second memory connected to the second processor and encoding computer readable instructions, including processor executable program instructions, the computer readable instructions accessible to the second processor, wherein the processor executable program instructions, when executed by the second processor, cause the second processor to perform operations comprising:

receiving an electronic message comprising an indication of a zone controller available to be programmed;

selecting an available zone controller to control the lighting in the illumination control zone;

configuring the selected zone controller to control the lighting in the illumination control zone based on sending to the selected zone controller an electronic message comprising a lighting command; and, automatically providing a remotely configurable lighting display in the illumination control zone based on sending to the selected zone controller an electronic message causing the selected zone controller to implement the lighting command;

wherein the second memory further comprises data encoding a listing of a plurality of remote controls addressable by the second processor; and, the operations performed by the second processor further comprise:

sending an electronic message to initiate negotiation among a plurality of remote controls to select one remote control as an illumination control session coordination leader;

receiving an electronic message comprising an indication of available illumination control session coordination leader candidates; and receiving an electronic message comprising selection of the second processor as the illumination control session coordination leader.

11. The apparatus of claim 10, wherein the lighting command further comprises a lighting pattern.

12. The apparatus of claim 10, wherein the lighting command further comprises a lighting sequence.

13. The apparatus of claim 10, wherein the indication the zone controller is available to be programmed further comprises an indication a plurality of zone controllers are available to be programmed.

14. The apparatus of claim 10, wherein the remote control further comprises a user interface operably coupled with the second processor, and wherein the operations performed by the second processor further comprise selecting the available zone controller as a function of user input received by the second processor in response to the second processor presenting a representation of available zone controllers to the user through the user interface.

15. The apparatus of claim 14, wherein the operations performed by the second processor further comprise the lighting command selected as a function of user input received by the second processor in response to the second processor presenting a representation of available lighting commands to the user in the user interface.

16. The apparatus of claim 14, wherein the user interface further comprises a user-operable mobile device application implemented via processor-executable program instructions executed as a function of user activity captured by the user interface.

17. The apparatus of claim 14, wherein the zone controller further comprises a multiple-zone controller configured to selectively and independently govern illumination in a plurality of illumination control zones.

18. The apparatus of claim 14, wherein the operations performed by the second processor further comprise:

sending to at least one of the plurality of remote controls an electronic message comprising a lighting command to be activated in at least one zone controller governed by the at least one of the plurality of remote controls.

19. The apparatus of claim 14, wherein the operations performed by the second processor further comprise sending an electronic message comprising a user selected pattern for the zone controller outputs to the user selected zone in the selected zone controller bypassing the zone controller's internal pattern generators.

20. The apparatus of claim 14, wherein the operations performed by the second processor further comprise coordinating display sequences and zone controller patterns based on synchronizing individual zone controller outputs in the selected zones.

21. The apparatus of claim 14, wherein the zone controller wireless communication interface is communicatively, operably, and wirelessly connected with the remote control wireless communication interface, thereby communicatively, operably, and wirelessly connecting the first processor with the second processor.

22. A decorative lighting control apparatus configured to independently and selectively activate decorative lighting in an illumination control zone, comprising:

a zone controller, comprising:

a first processor;

a wireless communication interface operably coupled with the first processor;

an input/output interface, operably coupled with the first processor, wherein the input/output interface is adapted to selectively and independently power and control a plurality of lighting elements operably coupled with the input/output interface; and, a first memory that is not a transitory propagating signal, the first memory connected to the first processor and encoding computer readable instructions, including processor executable program instructions, the computer readable instructions accessible to the first processor, wherein the processor executable program instructions, when executed by the first processor, cause the first processor to perform operations comprising:

sending an electronic message comprising an indication the zone controller is available to be programmed;

receiving an electronic message comprising an indication of the zone controller to be programmed;

receiving an electronic message comprising a lighting command; and, automatically providing a remotely configurable lighting display in the lighting zone based on independently activating the lighting command in the zone controller;

a remote control, comprising:

a second processor;

a wireless communication interface operably coupled with the second processor; and, a second memory that is not a transitory propagating signal, the second memory connected to the second processor and encoding computer readable instructions, including processor executable program instructions, the computer readable instructions accessible to the second processor, wherein the processor executable program instructions, when executed by the second processor, cause the second processor to perform operations comprising:

receiving an electronic message comprising an indication of a zone controller available to be programmed;

selecting an available zone controller to control the lighting in the illumination control zone;

configuring the selected zone controller to control the lighting in the illumination control zone based on sending to the selected zone controller an electronic message comprising a lighting command; and, automatically providing a remotely configurable lighting display in the illumination control zone based on sending to the selected zone controller an electronic message causing the selected zone controller to implement the lighting command;

wherein the remote control further comprises a user interface operably coupled with the second processor, and wherein the operations performed by the second processor further comprise selecting the available zone controller as a function of user input received by the second processor in response to the second processor presenting a representation of available zone controllers to the user through the user interface; and wherein the second memory further comprises data encoding a listing of a plurality of remote controls addressable by the second processor; and, the operations performed by the second processor further comprise:

sending an electronic message to initiate negotiation among a plurality of remote controls to select one remote control as an illumination control session coordination leader;

receiving an electronic message comprising an indication of available illumination control session coordination leader candidates;

receiving an electronic message comprising selection of the second processor as the illumination control session coordination leader; and sending to at least one of the plurality of remote controls an electronic message comprising a lighting command to be activated in at least one zone controller governed by the at least one of the plurality of remote controls.

* * * * *